US006977362B2

(12) United States Patent
Ohishi et al.

(10) Patent No.: US 6,977,362 B2
(45) Date of Patent: Dec. 20, 2005

(54) INDUCTION HEATING DEVICE WITH A SWITCHING POWER SOURCE AND IMAGE PROCESSING APPARATUS USING THE SAME

(75) Inventors: Hiroto Ohishi, Kanagawa (JP); Masae Sugawara, Miyagi (JP)

(73) Assignees: Ricoh Company, Ltd., Tokyo (JP); Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/890,242

(22) Filed: Jul. 14, 2004

(65) Prior Publication Data

US 2004/0264218 A1 Dec. 30, 2004

Related U.S. Application Data

(62) Division of application No. 10/452,313, filed on Jun. 3, 2003, now Pat. No. 6,806,448, which is a division of application No. 09/741,791, filed on Dec. 22, 2000, now Pat. No. 6,630,651.

(30) Foreign Application Priority Data

| | | |
|---|---|---|
| Dec. 4, 1999 | (JP) | 11-366429 |
| May 9, 2000 | (JP) | 2000-135464 |
| Aug. 17, 2000 | (JP) | 2000-247805 |

(51) Int. Cl.[7] ..... H05B 6/10

(52) U.S. Cl. ..... 219/662; 219/660; 363/21.04

(58) Field of Search ..... 219/662, 619, 219/671, 216, 469, 626, 622, 660, 656, 667, 219/661, 627, 506; 399/328–333; 373/139, 373/142, 147, 152; 363/127, 89, 21.04; 307/31, 307/39

(56) References Cited

U.S. PATENT DOCUMENTS

| | | | | |
|---|---|---|---|---|
| 3,376,915 A | | 4/1968 | Chandley | |
| 3,781,506 A | * | 12/1973 | Ketchum et al. | 219/627 |
| 4,114,009 A | | 9/1978 | Kiuchi et al. | |
| 4,129,767 A | | 12/1978 | Amagami et al. | |
| 4,151,387 A | * | 4/1979 | Peters, Jr. | 219/626 |
| 4,169,222 A | * | 9/1979 | Tucker | 219/626 |
| 5,666,627 A | | 9/1997 | Yamaguchi | |
| 5,752,150 A | | 5/1998 | Kato et al. | |
| 5,777,503 A | | 7/1998 | Faulk | |
| 5,822,669 A | | 10/1998 | Okabayashi et al. | |
| 5,895,598 A | | 4/1999 | Kitano et al. | |
| 6,307,875 B1 | | 10/2001 | Tsuda et al. | |
| 6,351,403 B2 | | 2/2002 | Abdoulin | |
| 6,597,157 B1 | | 7/2003 | Boeckmann et al. | |

FOREIGN PATENT DOCUMENTS

| | | |
|---|---|---|
| JP | 5-091260 | 4/1993 |
| JP | 9-106207 | 4/1997 |
| JP | 9-140135 | 5/1997 |
| JP | 2000-214725 | 4/2000 |

* cited by examiner

*Primary Examiner*—Quang Van
(74) *Attorney, Agent, or Firm*—Oblon, Spivak, McClelland, Maier & Neustadt, P.C.

(57) ABSTRACT

An induction heating device includes a plurality of induction coils connected to a single high-frequency power source and each being able to be ON/OFF controlled by a switch. A current is selectively fed only to desired part of the induction coils or to all of the induction coils connected in parallel. The coils are driven by a current fed thereto at the same time in the same phase. The device may include inverters for controlling power to be fed coil by coil. The device is free from interference and irregular heating and can readily cope with a change in a heating range while controlling power coil by coil.

4 Claims, 23 Drawing Sheets

INDUCTION HEATING DEVICE WITH A SWITCHING POWER SOURCE AND IMAGE PROCESSING APPARATUS USING THE SAME

CROSS-REFERENCE TO RELATED APPLICATIONS

The present application is a divisional of U.S. application Ser. No. 10/452,313 filed on Jun. 3, 2003, U.S. Pat. No. 6,806,448 which in turn is a divisional of U.S. application Ser. No. 09/741,791 filed on Dec. 22, 2000, U.S. Pat. No. 6,630,651 and in turn claims priority to JP 11-366429 filed on Dec. 24, 1999, JP 2000-135464 filed on May 9, 2000, and JIP 2000-247805 filed on Aug. 17, 2000, the entire contents of each of which are hereby incorporated herein by reference.

BACKGROUND OF THE INVENTION

The present invention relates to an induction heating device of the type including a switching power source and an image processing device using the same.

An induction heating device of the type described is applicable not only to various furnaces including a metal melting furnace, a plate heating furnace and a hardening furnace, but also to a fixing unit that fixes a toner image on a recording medium in an electrophotographic process. An image processing apparatus may be typified by a copier, a facsimile apparatus and a combination thereof. In a copier, for example, a switching power source often includes a plurality of different lines each including a converter or an inverter. The prerequisite with this kind of switching power source is that sound ascribable to noise interference be obviated. For this purpose, a particular frequency is assigned to each line while a difference in switching frequency between the lines is selected to be higher than an audible range. In practice, however, a low switching frequency must sometimes be used. A transformer included in a line whose switching frequency is low has its iron loss or hysteresis loss aggravated, resulting in a bulky, expensive configuration. Consequently, the switching power source with such a transformer makes the entire device bulky and expensive.

The induction heating device includes an induction coil adjoining a magnetic heating member. A high-frequency current is fed to the induction coil in order to generate a magnetic flux in the heating member. The magnetic flux generates an induced current in a conductive layer formed on the heating member. The resulting Joule heat heats the surface of the heating member to a preselected temperature. To miniaturize the induction heating device and to render the amount of heat adjustable, it is necessary to use a plurality of induction coils or split induction coils and to control each induction coil independently of the others. For this purpose, it is a common practice to use a switching power source for driving the individual induction coil. The switching power source includes a plurality of inverters, or high-frequency power sources, each for controlling a particular induction coil. This, however, brings about a problem that a magnetic flux generated by any one of the induction coils effects the other induction coils. As a result, the inverters interfere with each other and fail to operate.

The following approaches (1) through (3) have been proposed to obviate the interference between the inverters.

(1) The induction coils are positioned remote from each other or isolated from each other by shield plates.

(2) A plurality of induction coils (including split induction coils) are replaced with a single induction coil connected to a single inverter. A gap between the induction coil and a heating element is varied in order to distribute the amount of heat.

(3) A plurality of parallel induction coils are connected to a single large-capacity inverter.

The above approach (1), however, causes irregular heating to occur. The approach (2) cannot cope with a change in the dimension of a heating range or that of an object to be heated. Further, the approach (3) has a problem that a main switching device, constituting the inverter, controls power to be fed to the induction coils, i.e., simply varies the power over all of the induction coils, as distinguished from the individual induction coil. As a consequence, the induction heating device is sophisticated and must have the induction coils to be adjusted, resulting in low reliability. Moreover, the induction heating device is expensive and bulky and has heretofore not been extensively used.

Technologies relating to the present invention are disclosed in, e.g., Japanese Patent Laid-Open Publication Nos. 5-91260, 9-106207, 9-140135 and 2000-214725.

SUMMARY OF THE INVENTION

It is therefore an object of the present invention to provide an energy saving, reliable, small size, low cost power source device capable of obviating sound ascribable to noise interference between adjoining lines, reducing the iron loss or hysteresis loss of a transformer of the individual line, and assigning high frequencies to the adjoining lines.

It is another object of the present invention to provide an energy saving, reliable, low cost, small size induction heating device capable of obviating interference between inverters and irregular heating, readily coping with a change in the dimension of a heating range or that of an object to be heated, and controlling power coil by coil in order to vary a heat generation pattern.

It is a further object of the present invention to provide an image processing apparatus using an induction heating device in a fixing device thereof.

In accordance with the present invention, in a power source device including a plurality of switching power source lines each including a conversion circuit, which selectively turns on or turns off an input by switching, and a controller for controlling the switching operation of the conversion circuit, the controller assigned to one of the switching power source lines variably controls an ON width or an OFF width while the controller assigned to the other switching power source line executes control with a control signal produced by thinning down a signal synchronous to the one switching power source line.

Also, in accordance with the present invention, in an induction heating device including a power source device including a plurality of switching power source lines each including a conversion circuit, which selectively turns on or turns off an input by switching, and a controller for controlling the switching operation of the conversion circuit, the plurality of switching power source lines operate as power sources for feeding currents to a plurality of induction coils, which heat a heating member by induction, while the controllers execute feedback control in accordance with temperatures of the portions of the heating member corresponding in position to the induction coils.

Further, in accordance with the present invention, in an induction heating device including a plurality of induction coils for heating a heating member by induction, the induction coils are connected to a single high-frequency power source device in parallel. The high-frequency power source device controls a current for each induction coil. Alternatively, the induction coils may be connected to the high-frequency power source device in series.

Moreover, in accordance with the present invention, in an image processing apparatus using an induction heating device, which includes a plurality of induction coils for heating a heating member by induction, as fixing means for fixing an image with heat, the induction coils are connected to a single high-frequency power source device in parallel. The high-frequency power source device controls a current for each induction coil. Alternatively, the induction coils may be connected to the high-frequency power source device in series.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
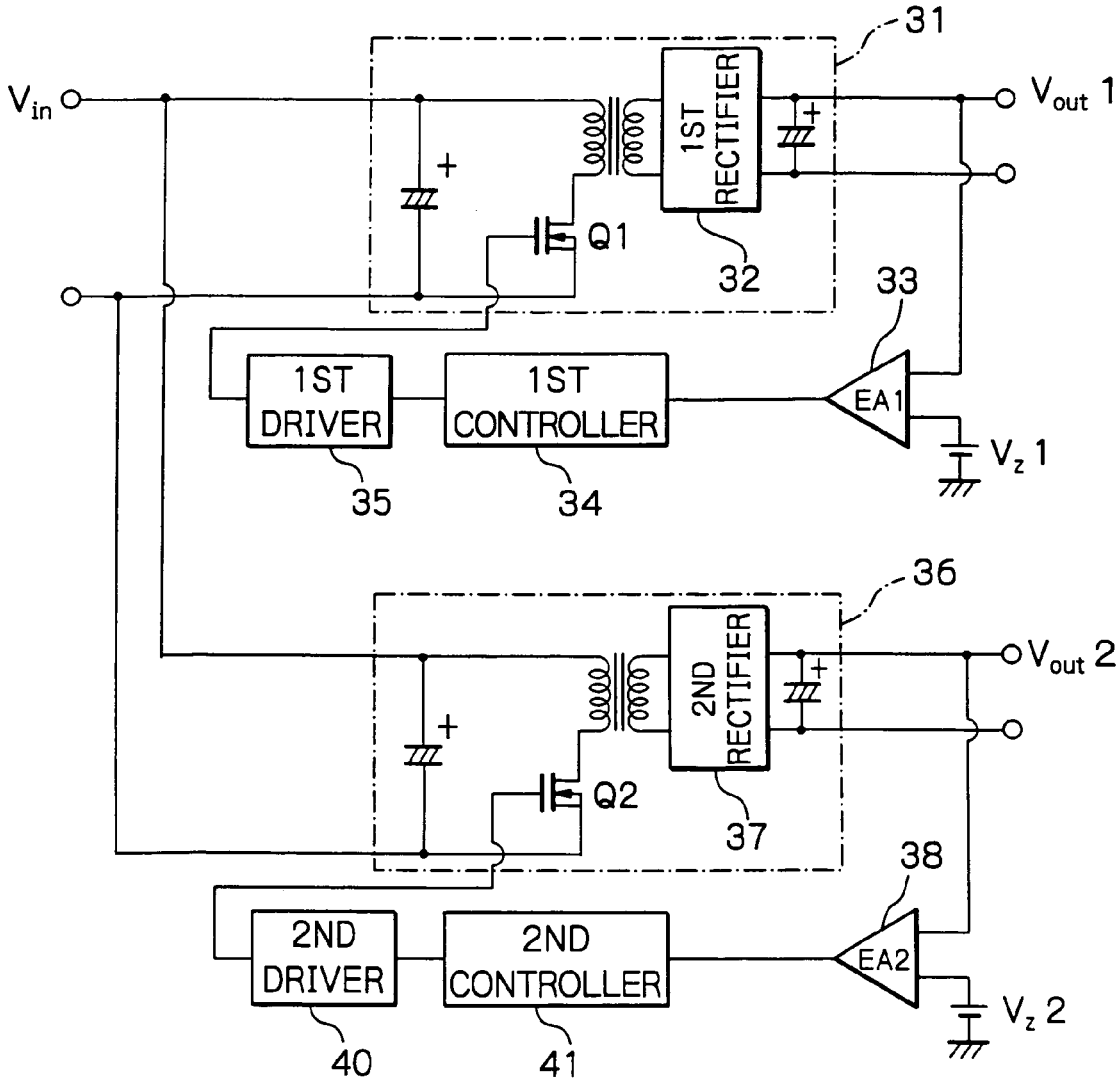
Fig. 1 PRIOR ART
FIG. 1 is a block diagram schematically showing a conventional switching power source including converter sections arranged on two lines.

To better understand the present invention, brief reference will be made to a conventional switching power source applicable to a copier or similar image processing apparatus and including a plurality of converter lines, shown in FIG. 1. As shown, the switching power source includes two identical lines or circuitry operable independently of each other. Specifically, a fist and a second converter section 31 and 36 include switching devices Q1 and Q2, respectively. A first and a second driver 35 and 40 apply pulses, the ON width or the OFF width of which is variable, to the switching devices Q1 and Q2, respectively. In response, the switching devices Q1 and Q2 each switch, i.e., turn on or turn off an input voltage Vin. The input voltages output from the switching devices Q1 and Q2 are respectively converted to output voltages Vout1 and Vout2 via a first and a second rectifier 32 and 37. A first and a second error amplifier (EA1 and EA2) 33 and 38 respectively produce differences between the output voltages Vout1 and Vout2 and reference voltages Vz1 and Vz2 and amplify them. The differences, or errors, output from the error amplifiers 33 and 38 are respectively fed back to the drivers 35 and 40 via a first and a second controller 34 and 41 so as to stabilize the voltages Vout1 and Vout2.

The prerequisite with a switching power source device including a plurality of converter or inverter lines, as stated above, is that sound ascribable to noise interference between the independent lines be obviated. For this purpose, it has been customary to set up a difference in switching frequency above the audible frequency range between the lines, e.g., to assign switching frequencies of 80 kHz, 110 kHz and 140 kHz to a first, a second and a third line (converter). This, however, cannot be done without using even low frequencies, as stated earlier. As a result, a transformer included in a line, to which a low switching frequency is assigned, has its iron loss or hysteresis loss aggravated and must therefore be increased in size, resulting in an increase in cost. Moreover, the entire switching power source becomes bulky and expensive.

Figure 2:
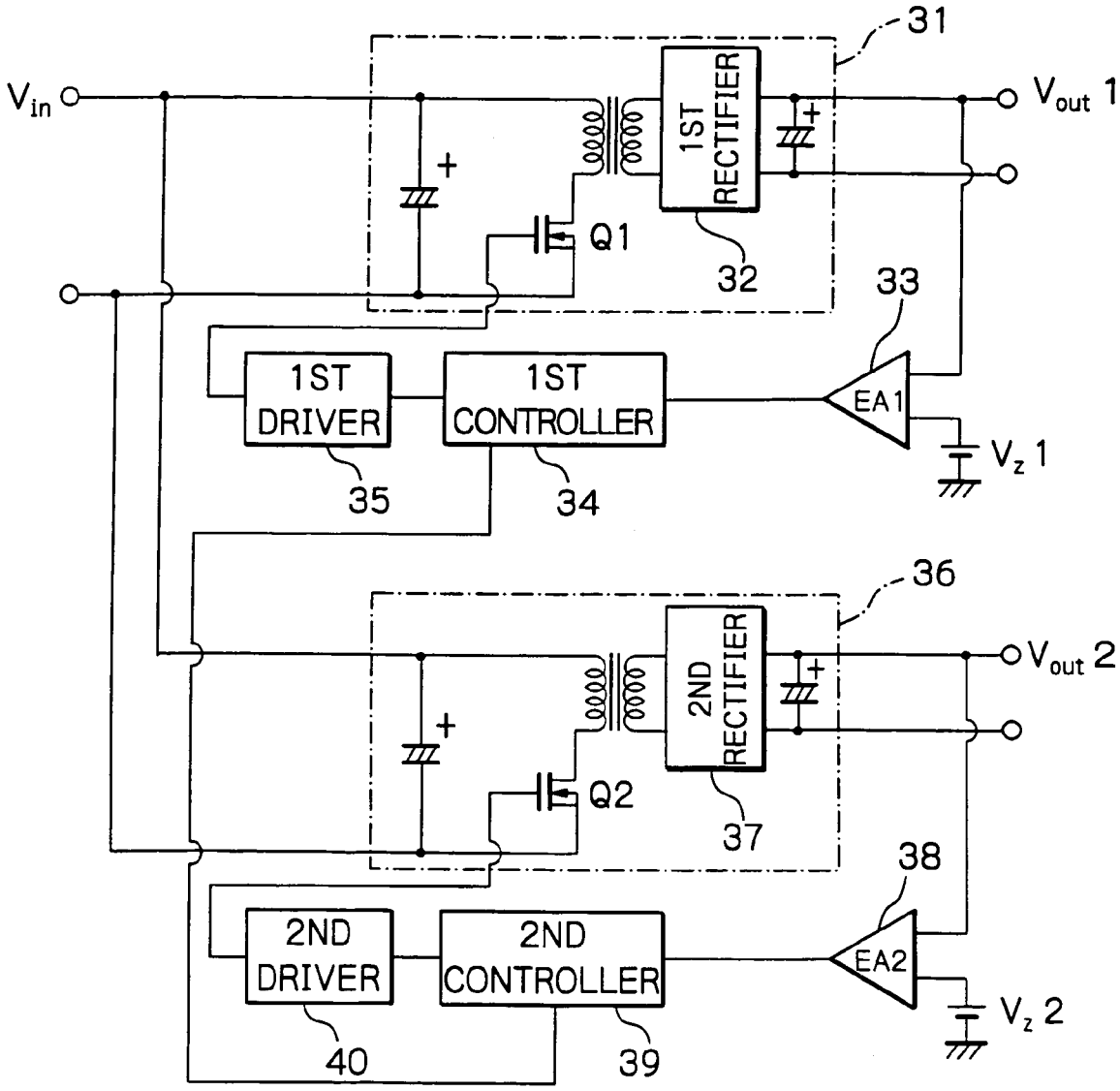
FIG. 2 is a schematic block diagram showing a first embodiment of the switching power source in accordance with the present invention including converter sections arranged on two lines.

Referring to FIG. 2, a first embodiment of the switching power source in accordance with the present invention is shown. As shown, a first converter section 31 includes a first switching device Q1 and a first rectifier 32. A first driver 35 applies pulses, the ON width or the OFF width of which is variable, to the switching device Q1. In response, the switching device Q1 switches, i.e., turns on or turns off an input voltage Vi. The voltage Vi output from the switching device Q1 is converted to an output voltage Vout1 via the rectifier 32. A first error amplifier (EA1) 33 produces a difference between the output voltage Vout1 and a reference voltage Vz1 assigned thereto and amplifies it. The difference, or error, output from the error amplifier 33 is fed back to the driver 35 via a controller 34 so as to stabilize the voltage Vout1 at the reference voltage.

A second driver 40 applies pulses, which have been thinned down or reduced, to a second switching device Q2. In response, the switching device Q2 switches, i.e., turns on or turns off the input voltage Vin. The voltage Vin output from the switching device Q2 is converted to an output voltage Vout2 via a second rectifier 37. A second error amplifier (EA2) 38 produces a difference between the output voltage Vout2 and a reference voltage Vz2 assigned thereto and amplifies it. The difference, or error, output from the error amplifier 38 is fed back to the driver 40 via a thin-down controller 39 so as to stabilize the output voltage Vout2. In the illustrative embodiment, the driver 40 outputs drive pulses asynchronous to drive pulses output from the driver 35 in accordance with a control signal input thereto. More specifically, the controller 34 delivers a synchronization control signal to the thin-down controller 39. The thin-down controller 39 feeds a control signal to the driver 40 in accordance with the synchronization control signal and the output of the error amplifier 38.

While the converter sections 31 and 36 each are shown as including a single switching device Q1 or Q2, any other suitable converter circuit may be used. Also, the switching devices Q1 and Q2 implemented by FETs (Field Effect Transistors) may be replaced with any other suitable switching devices. The error amplifiers 33 and 38 may be identical with error amplifiers conventionally included in a switching power source. In addition, a photocoupler may be connected between, e.g., each of the error amplifiers 33 and 38 and associated one of the controllers 34 and 39 for an insulating purpose.

As stated above, in the illustrative embodiment, a first converter or inverter line is controlled by pulses having a variable ON or OFF width. A second converter or inverter line is controlled by thinned pulses output by thinning down a signal that is synchronous to the first line. High frequencies can therefore be assigned to all of the independent lines. In addition, the feed of a high-frequency current only to the first line and the feed of the current to a plurality of parallel lines can be switched over. This successfully obviates sound ascribable to noise interference between the independent lines and thereby reduces the iron loss or hysteresis loss of a transformer included in the individual line. The illustrative embodiment therefore realizes an energy saving, reliable, small size switching power source.

Figure 3:
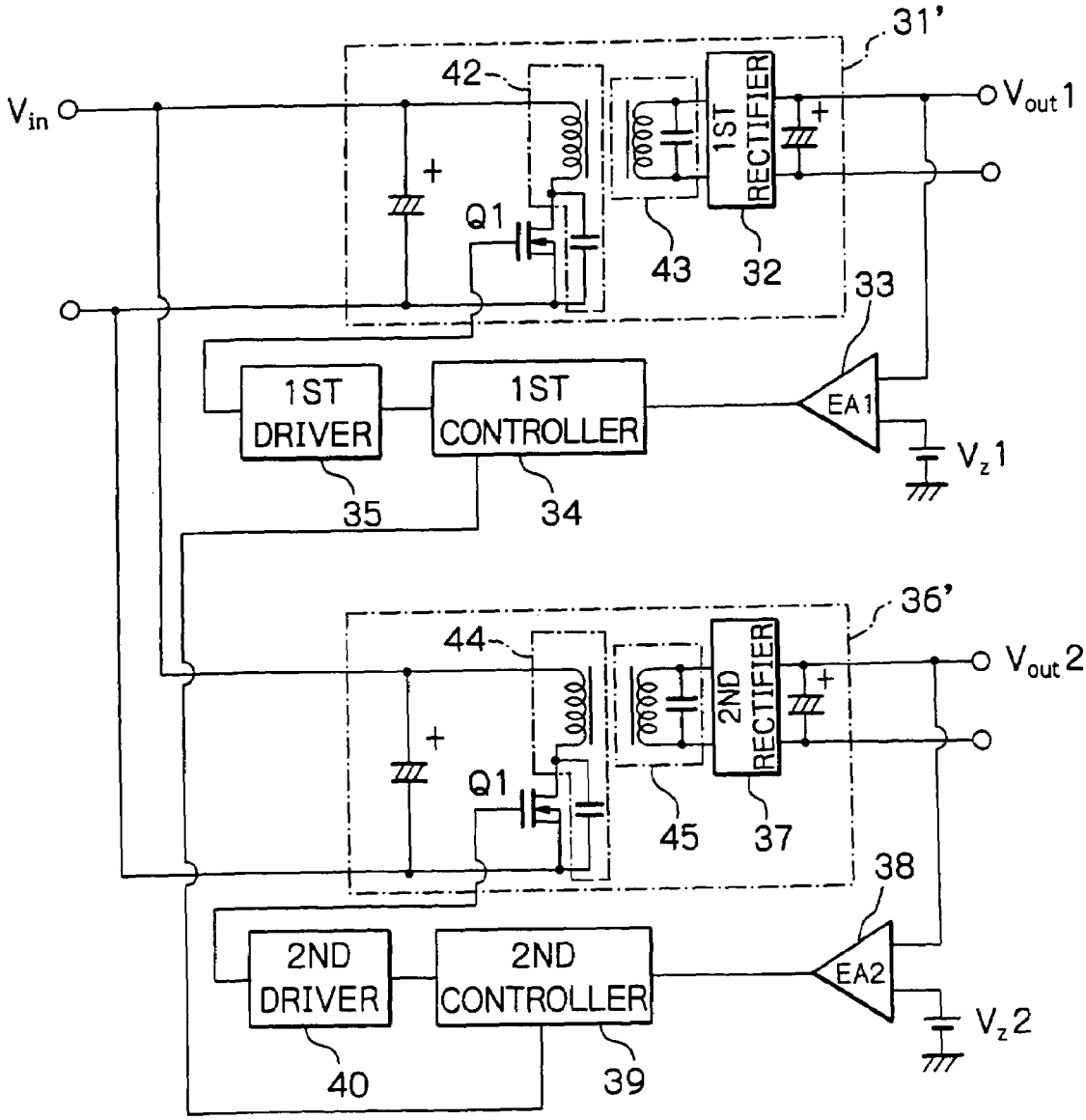
FIG. 3 is a schematic block diagram showing a second embodiment of the switching power source in accordance with the present invention also including converter sections arranged on two lines.

A second embodiment of the switching power source in accordance with the present invention will be described with reference to FIG. 3. As shown, this embodiment is identical with the first embodiment except that it causes the first and second converter sections to operate in a resonance system. Specifically, as shown in FIG. 3, a first converter section 31' includes a transformer having a primary side and a secondary side implemented as a first primary and a first secondary resonance circuit 42 and 43, respectively. Likewise, a second converter section 36' includes a transformer having a primary side and a secondary side implemented as a second primary and a second secondary resonance circuit 44 and 49, respectively. In FIG. 3, structural elements identical with the structural elements shown in FIG. 2 are designated by identical reference numerals and will not be described specifically in order to avoid redundancy.

In the configuration shown in FIG. 3, a controller 34 and a thin-down controller 39 feeds control signals to a first and a second driver 35 and 40, respectively. In response, the drivers 35 and 40 switch the low voltage, small current portions of the converter sections 31' and 36', respectively. This allows switching devices, or switches, having a small capacity to be used for the ON/OFF switching purpose. Further, the resonance system reduces the size and therefore the cost of each converter section. In addition, efficient operation is achievable due to a small switching loss.

If desired, the second converter section 36' may be turned on and turned off by a signal input from outside the circuitry, although not shown in FIG. 3. Of course, the number of converter sections is not limited to two, but may be three or more, as needed. In the illustrative embodiment, the converter sections 31' and 36' are respectively controlled on the basis of the voltages detected by the error amplifiers 33 and 38. Alternatively, the converters 31' and 36' each may be controlled on the basis of the outputs of a plurality of error amplifiers. Further, while the resonance system of the converters 31' and 36' is implemented by voltage resonance circuits, it may be implemented by any other suitable resonance circuits and may additionally include a trigger sensing circuit and a protection circuit, if desired.

Before entering into a detailed description of an induction heating device of the present invention, a conventional inducting heating device will be described. Assume that a switching power source is used to drive a plurality of induction coils included in an induction heating device. Then, each induction coil is controlled by a particular inverter or high-frequency power source section, so that a plurality of inverters operate at the same time. Consequently, a magnetic flux generated by any one of the induction coils is apt to effect the other induction coils and cause the inverters to interfere with each other, practically disabling the inverters.

The following approaches (1) through (3) have been proposed to obviate the interference between the inverters.

Figure 4:
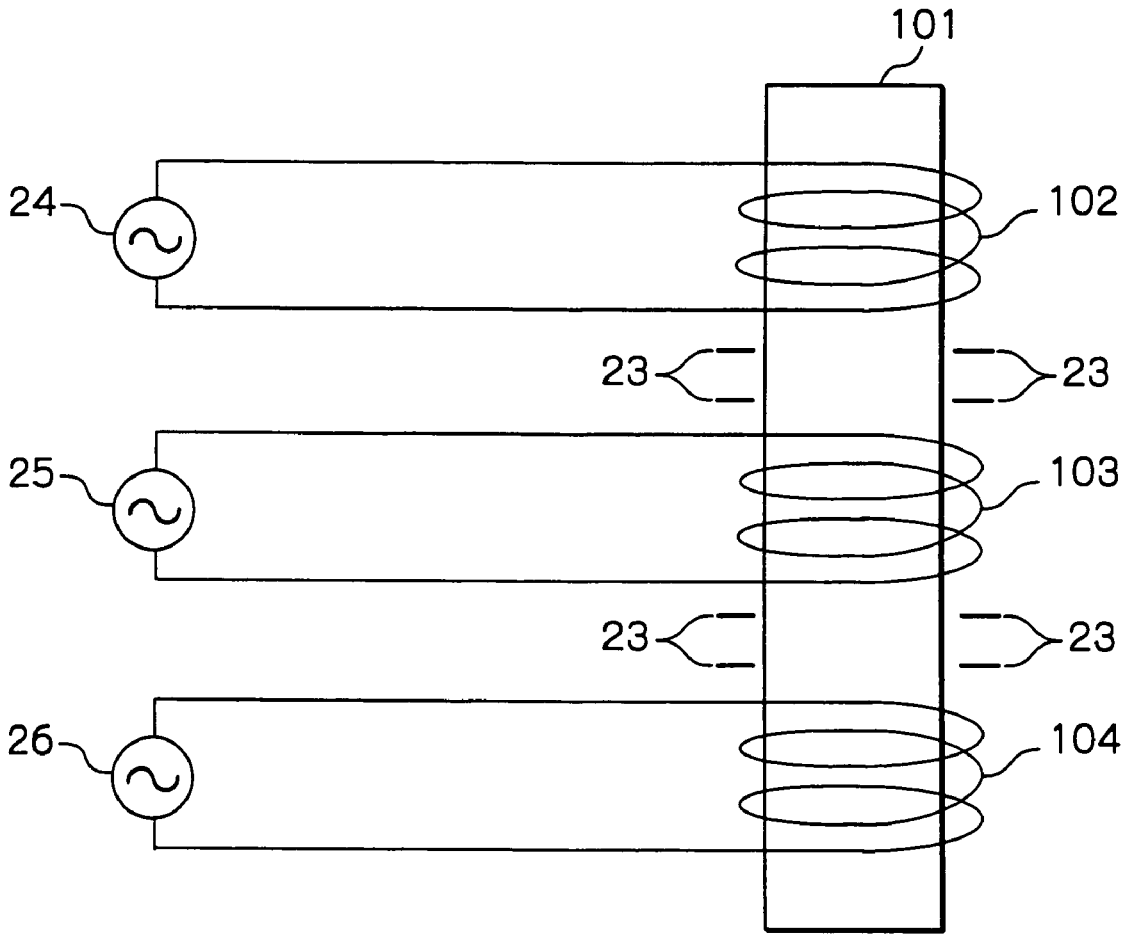
Fig. 4 PRIOR ART
FIG. 4 is a view showing the general configuration of a conventional induction heating device including shield plates.

(1) The induction coils are positioned remote from each other or isolated from each other by shield plates. Specifically, as shown in FIG. 4, high frequency power sources 24, 25 and 26 respectively drive a plurality of induction coils 102, 103 and 104 in order to form alternating magnetic fields in a heating member 101. Shield members 23 each isolate nearby ones of the induction coils 102 through 104, i.e., nearby ones of the magnetic fields.

Figure 5:
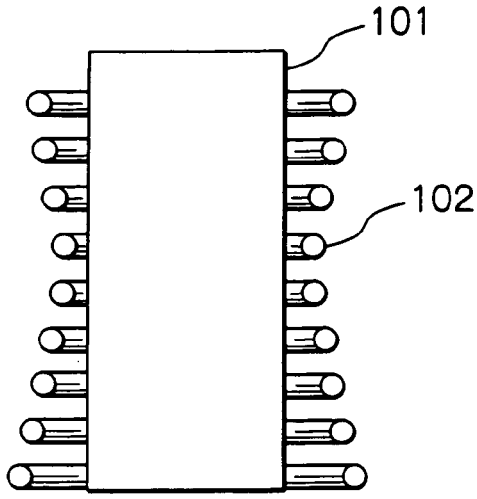
Fig. 5 PRIOR ART
FIG. 5 is a view showing another conventional induction heating device in which a gap between a heating member and a coil is varied.

(2) A plurality of induction coils (including split induction coils) are replaced with a single induction coil connected to a single inverter. The gap between the induction coil and a heating element is varied in order to distribute the amount of heat. For example, as shown in FIG. 5, the gap between an induction coil 102 and a heating member 101 is varied. The induction coil 102 causes alternating magnetic fields to act on the heating member 101.

Figure 6:
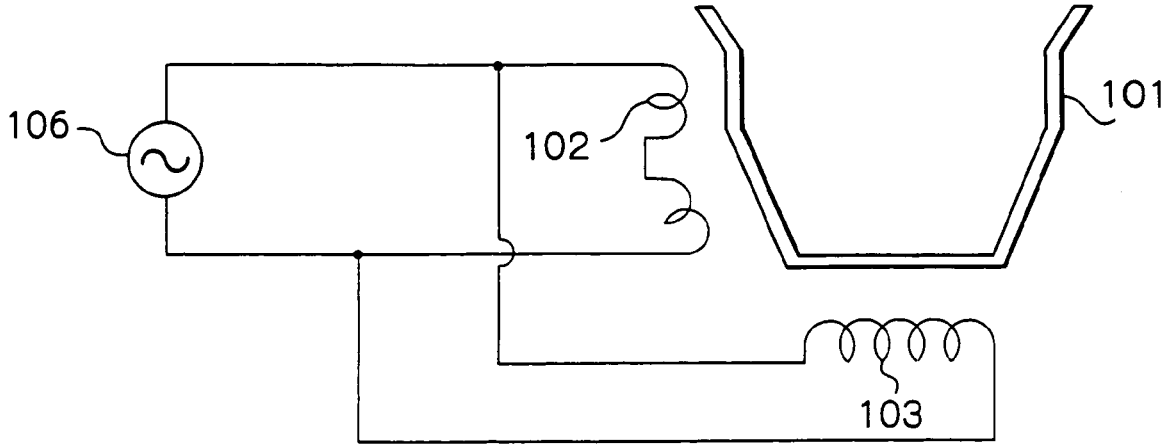
Fig. 6 PRIOR ART
FIG. 6 is a circuit diagram showing still another conventional induction heating device including induction coils connected in parallel.

(3) A plurality of parallel induction coils are connected to a single large-capacity inverter. For example, as shown in FIG. 6, a plurality of induction coils 102 and 103 are connected to a large-capacity inverter 106 in parallel. Alternating magnetic fields formed by the induction coils 102 and 103 act on a heating member 101.

However, the approaches (1) through (3) described above have the previously discussed problems left unsolved.

Figure 7A:
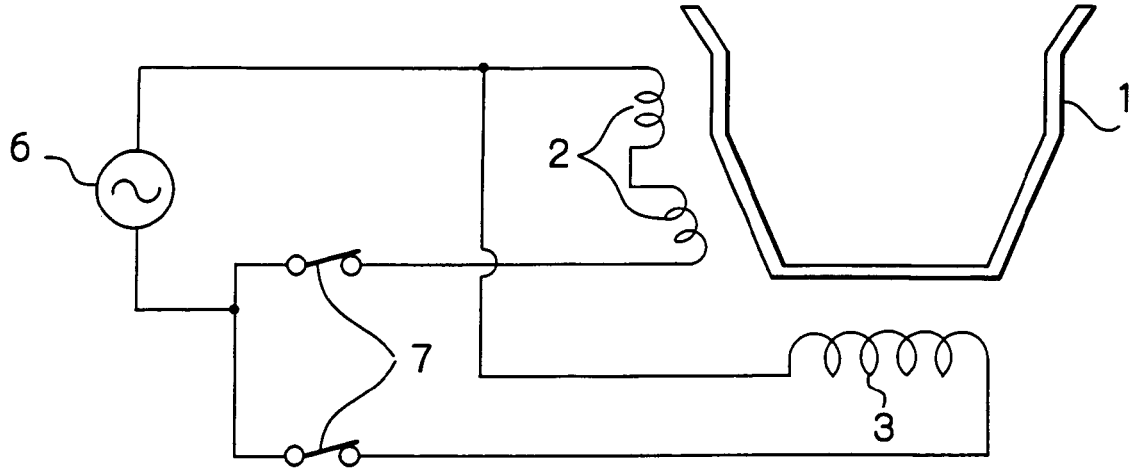
FIG. 7A is a circuit diagram showing a first embodiment of the induction heating device in accordance with the present invention.
Figure 7B:
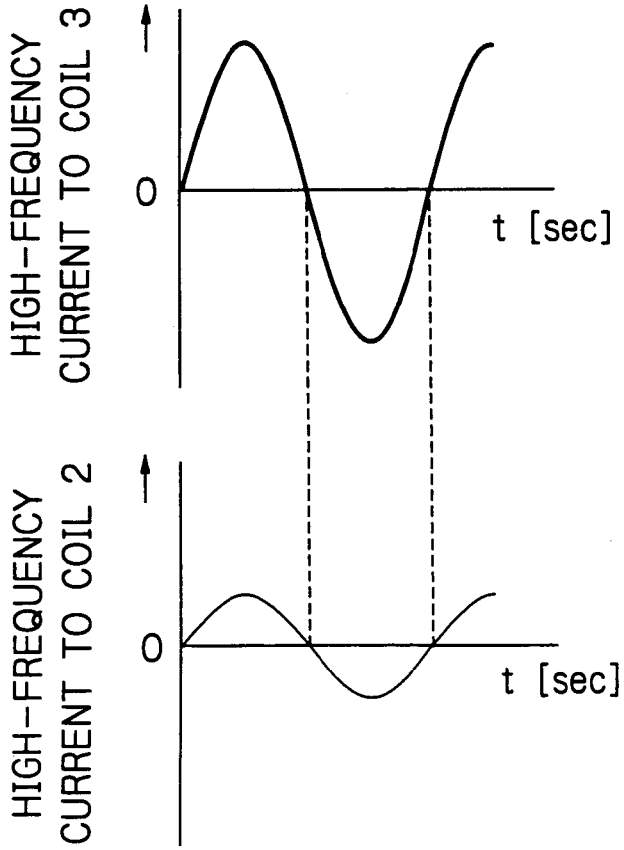
FIG. 7B is a timing chart showing high-frequency currents to be applied to induction coils included in the embodiment of FIG. 7A.
Figure 8:
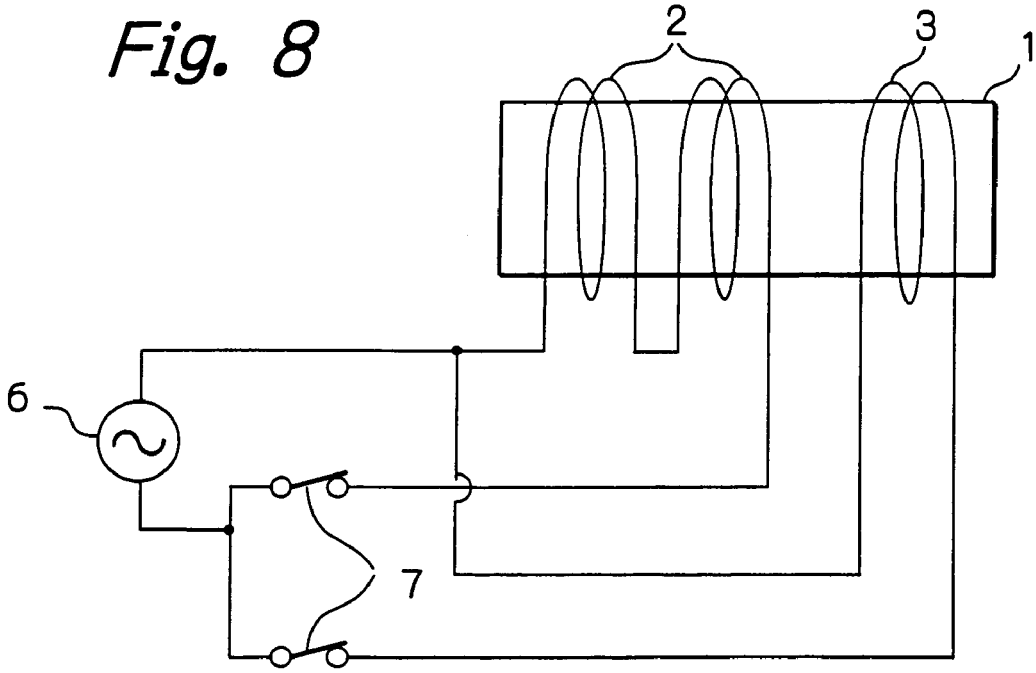
FIG. 8 is a circuit diagram showing another specific configuration of the first embodiment.

Reference will be made to FIGS. 7A, 7B and 8 for describing a first embodiment of the induction heating device in accordance with the present invention. As shown, the induction heating device includes a heating member 1, induction coils 2 and 3 connected in parallel, an AC power source 6, and switches or switching devices 7. The power source 6 is connected to each of the induction coils 2 and 3 via one of the switches 7. In this condition, when the switches 7 both are turned on, a high-frequency current is fed from the power source 6 to the induction coils 2 and 3 at the same time in the same phase, as shown in FIG. 7B specifically.

More specifically, the induction coils 2 and 3 connected to the power source 6 are wound round the heating member 1 at remote positions from each other, e.g., the inside and outside, different sides or upper and lower portions. When the alternating current is fed from the power source 6 to the induction coils 2 and 3, the resulting alternating magnetic fluxes are passed through the heating member while inducing a voltage in the heating member 1. The voltage, in turn, causes a current to flow through the heating member 1 and thereby causes the heating member 1 to generate heat. The heat is usable for various purposes, e.g., for hardening or melting metal, for boiling water, or for melting toner.

The specific configuration of the heating element shown in FIG. 7A is applicable to, e.g., a rice cooker or a metal melting furnace. On the other hand, the configuration shown in FIG. 8 is representative of a hollow cylinder applicable to a fixing device, which fixes an electrostatically formed toner image, or a flat plate applicable to a heating furnace.

Figure 9A:
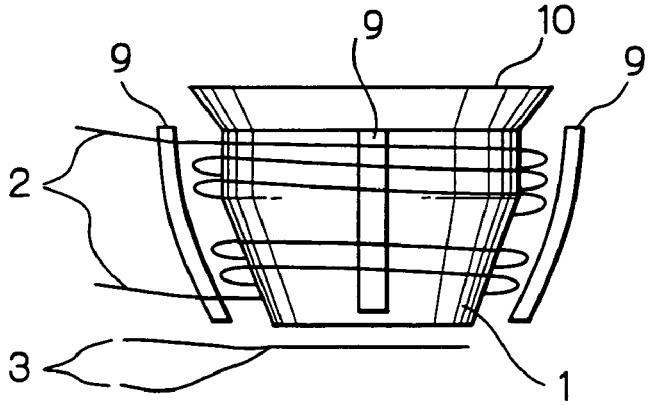
FIGS. 9A and 9B are views showing an example of the first embodiment specifically.
Figure 9B:
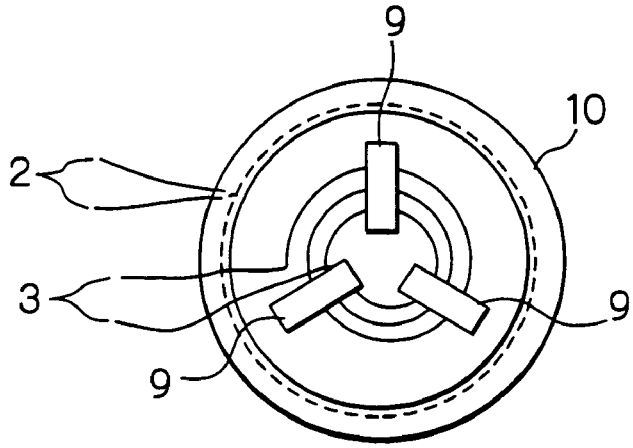

FIGS. 9A and 9B show a specific example of the illustrative embodiment. As shown, the heating element 1 is implemented as a pot or a melting pot and held by, e.g., a bobbin 1 positioned on the top of the heating element 1. Magnetic members 9 are affixed to the outside of the heating element 1 via the bobbin 10 in such a manner as to extend along the side of the heating element 1. The magnetic members 9 are formed of ferrite or similar magnetic material having high permeability, and each forms a closed magnetic circuit extending through it and the heating element 1. The induction coils 2 and 3 are wound between the heating member 1 and the magnetic members 9. The AC power source 6 is connected to the induction coils 2 and 3 via the switches 7, as stated earlier. It is to be noted that the arrangement shown in FIG. 8 may also include such magnetic members in order to form magnetic circuits.

In the specific configuration shown in FIGS. 9A and 9B, the alternating current fed from the power source 6 induces alternating magnetic fluxes passing through the closed magnetic paths, which are constituted by the heating element 1 and magnetic members 9. The magnetic fluxes induce a voltage in the heating member 1. The voltage, in turn, causes a current to flow through the heating member 1 and thereby causes the heating member 1 to generate heat. The heat may be used for any one of the specific purposes stated earlier.

Assume that the power supply 6 and main switching devices 7 constitute an inverter, although not shown in any one of FIGS. 7A, 7B and 8. Then, in the illustrative embodiment, a plurality of induction coils 2 and 3 are connected to the inverter in parallel and applied with a high-frequency current of identical phase at the same time in the same manner as when the switches 7 turn on and turn off the AC power source 6. In this case, the main switching devices 7 are selectively operated to feed the high-frequency current to only part of the parallel induction coils 2 and 3 or to all of the induction coils 2 and 3. This configuration has the following advantages (1) through (4).

(1) The inverter is free from interference.

(2) Irregular heating is reduced.

(3) A change in the dimension of the heating range or that of an object to be heated can be readily coped with.

(4) A fist and a second main switch that constitute the inverter can control power to be fed coil by coil.

The induction heating device with the above advantages (1) through (4) has an energy saving, reliable and miniature configuration.

Figure 10:
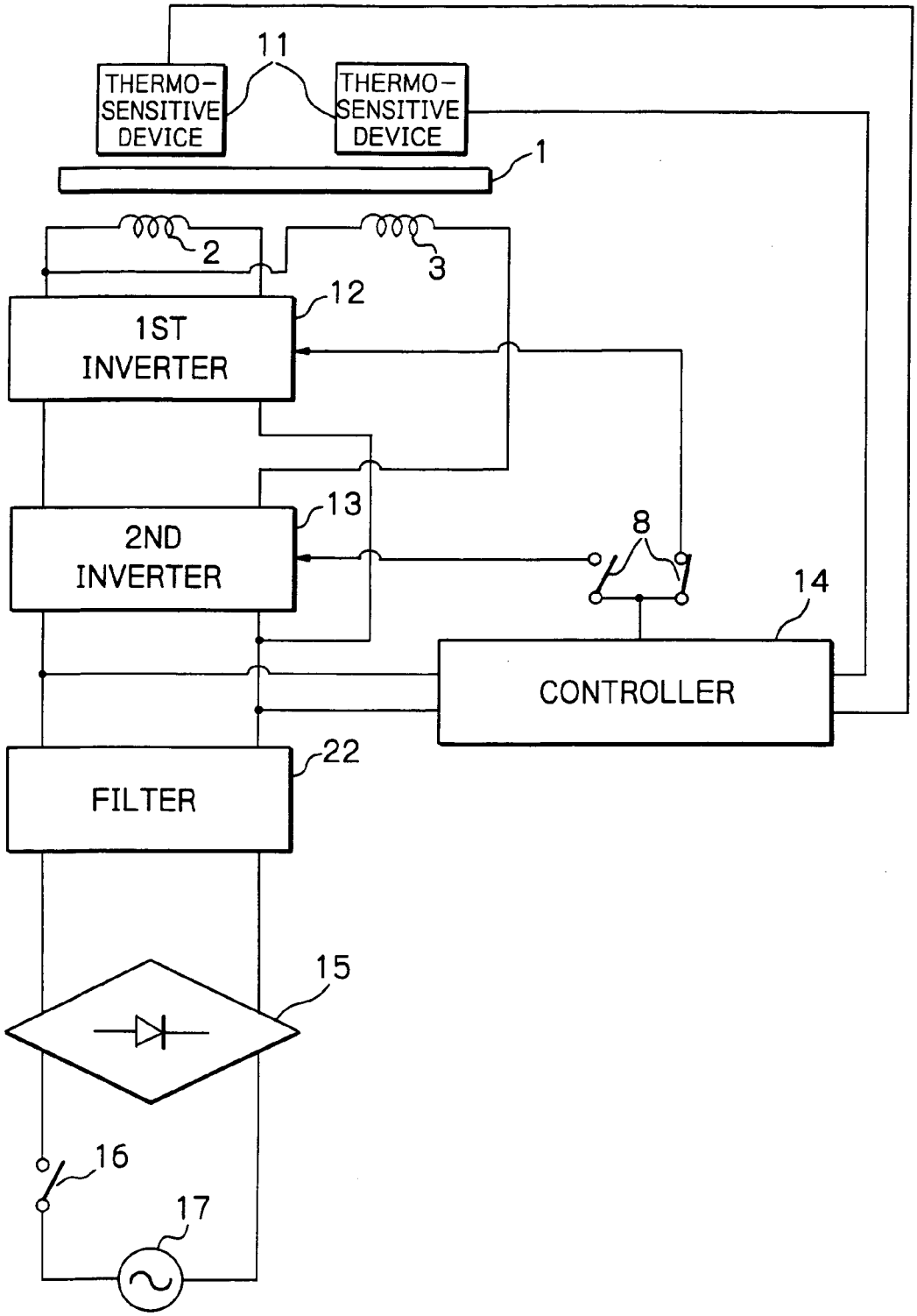
FIG. 10 is a schematic block diagram showing a second embodiment of the induction heating device in accordance with the present invention including inverters.

FIG. 10 shows a second embodiment of the induction heating device in accordance with the present invention. As shown, the induction heating device includes a heating member 1, induction coils 2 and 3, a switching device or switch 8, thermosensitive devices 11, a first and a second inverter 12 and 13, a controller 14, a rectifier 15, a switch 16, an AC power source 17, and a filter 22. The thermosensitive devices 11 each are responsive to the temperature of the heating member 1. In this configuration, a high-frequency current can be selectively fed to one or both of the induction coils 2 and 3 connected in parallel, as needed.

In the illustrative embodiment, the first and second inverters 12 and 13 feed currents to the induction coils 2 and 3, respectively. The switching device or switch 8 switches the inverters 12 and 13. The controller 14 controls the switching device 8 in accordance with signals generated inside the circuitry and including the outputs of the thermosensitive devices 11 and signals input from outside the circuitry. The AC power source 17, switch 16, rectifier 15 and filter 22 constitute an input circuit connected to the inputs of the inverters 12 and 13.

While the illustrative embodiment includes only two inverters 12 and 13, it may include three or more inverters, if desired. The two thermosensitive devices 11 may be replaced with three or more thermosensitive devices. Further, the circuitry may additionally include a trigger sensing circuit and a protection circuit, as needed.

The illustrative embodiment allows the inverters 12 and 13 to be switched in a low voltage, small current portion and can therefore use small-capacity switching devices or switches. This implements a small size, low cost configuration and reduces a switching loss.

Figure 11:
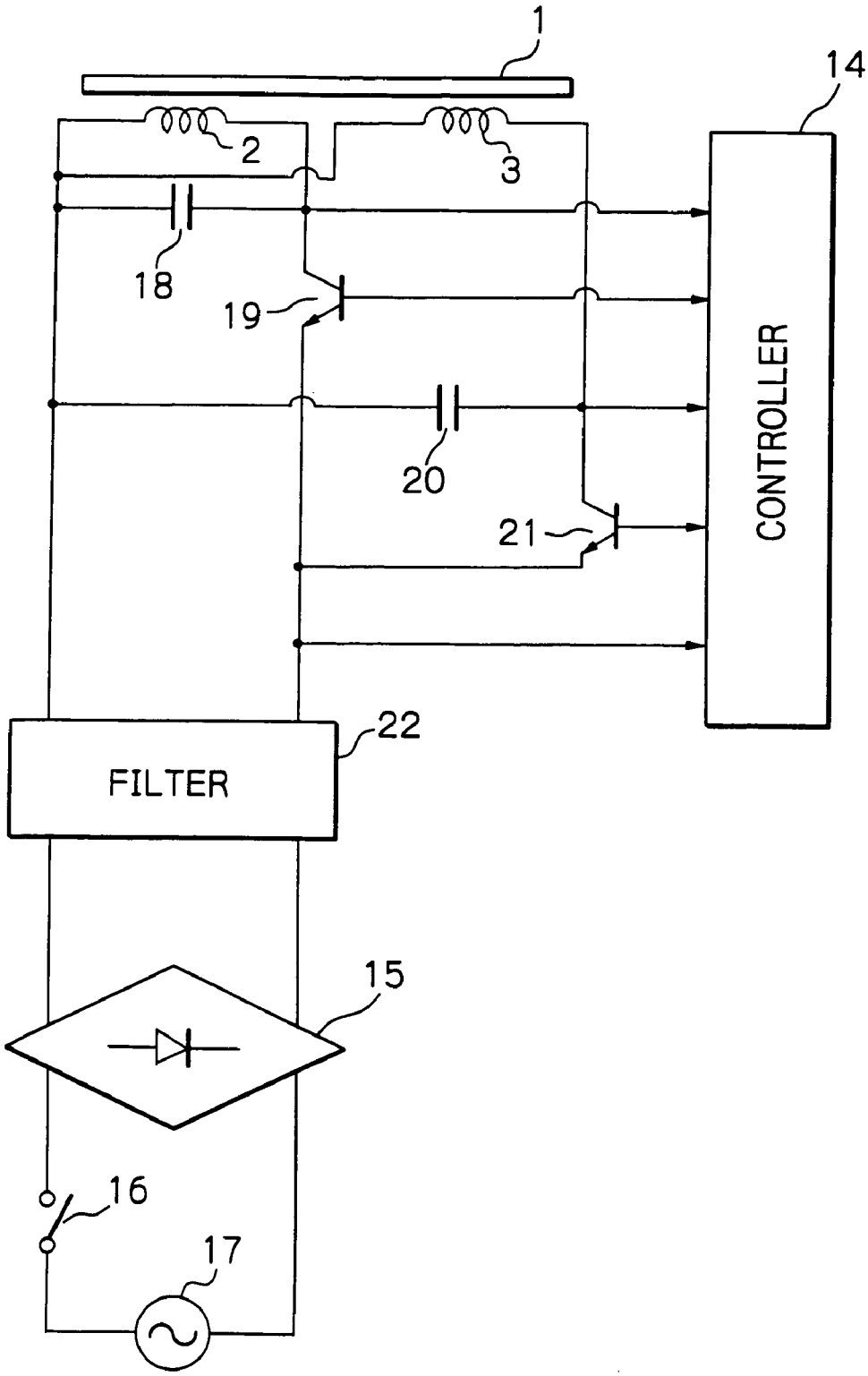
FIG. 11 is a schematic block diagram showing a third embodiment of the induction heating device in accordance with the present invention including induction coils to which capacitors are connected in parallel.

FIG. 11 shows a third embodiment of the induction heating device in accordance with the present invention. As shown, the induction heating device includes a heating member 1, induction coils 2 and 2, a controller 14, a rectifier 15, a switch 16, an AC power source 17, a first and a second capacitor 18 and 20 connected to the induction coils 2 and 3 in parallel, a first and a second main switching device 19 and 21, and a filter 22. In this configuration, too, a high-frequency current can be selectively fed to one or both of the induction coils 2 and 3 connected in parallel, as needed.

In the illustrative embodiment, the AC power source 17, switch 16, rectifier 15 and filter 22 constitute an input circuit connected to both of the induction coils 2 and 3. The first and second main switching devices 19 and 21 respectively control the feed of the high-frequency current to the induction coils 2 and 3. The input circuit and main switching devices 19 and 21 constitute two inverters in combination. The inverters are controlled by the controller 14 independently of each other and, in turn, drive the first and second capacitors 18 and 20, respectively. The main switching devices 19 and 21 may be implemented by transistors that perform switching operations under the control of the controller 14 to which the operating conditions of the induction coils 2 and 3 are fed back.

The two induction coils 2 and 3 are only illustrative and may be replaced with three or more induction coils. Again, the circuitry may additionally include a trigger sensing circuit and a protection circuit.

The illustrative embodiment extends the range over which the inductance of the induction coils 2 and 3 are adjustable, and therefore the range over which power to be fed is adjustable.

Figure 12:
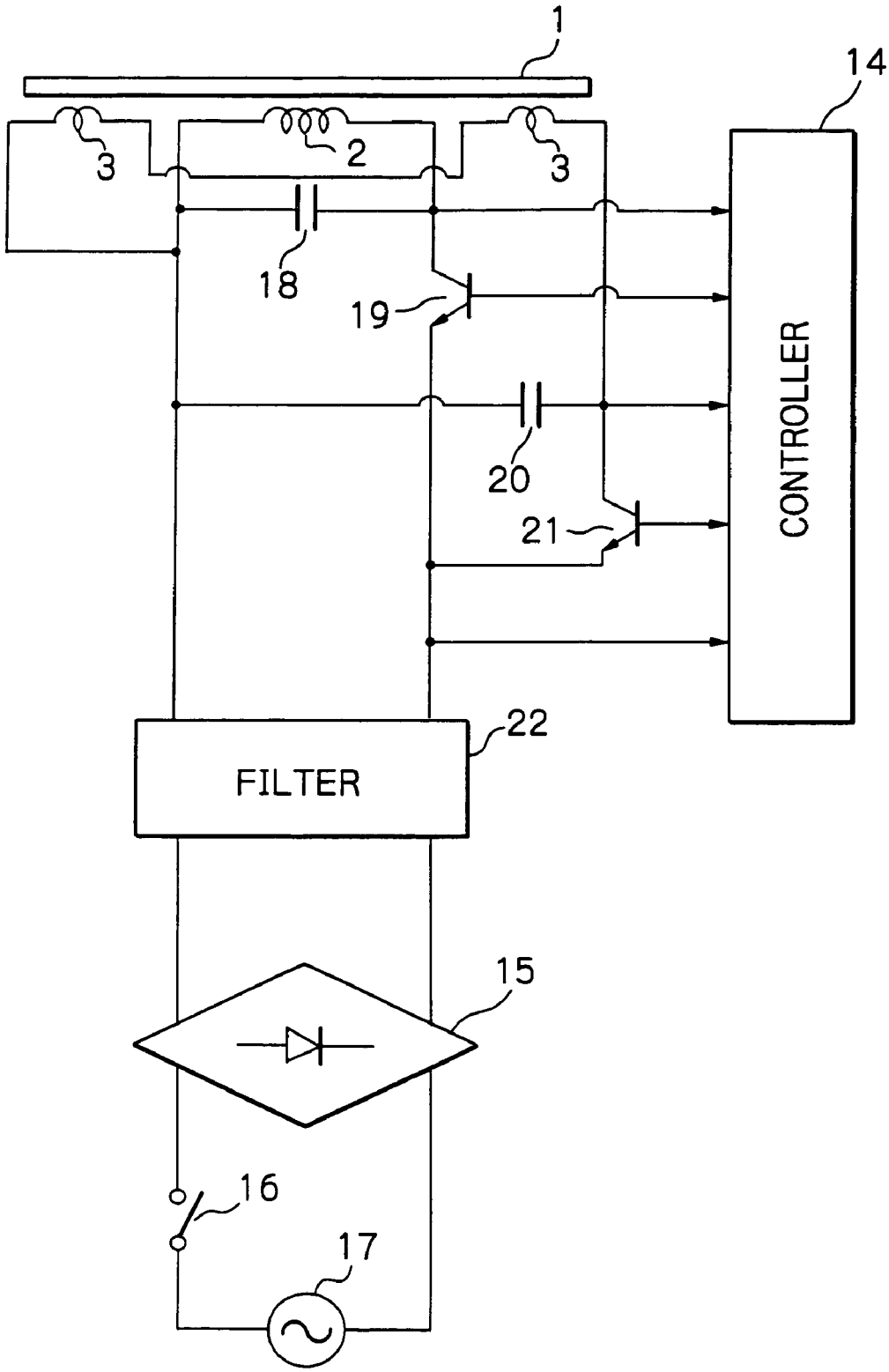
FIG. 12 is a schematic block diagram showing a fourth embodiment of the induction heating device in accordance with the present invention including split induction coils.

FIG. 12 shows a fourth embodiment of the induction heating device in accordance with the present invention. This embodiment is identical with the third embodiment except that the coil 3 is made up of two portions located at two different positions of the heating member 1. Structural elements identical with the structural elements of the third embodiment are designated by identical reference numerals and will not be described in order to avoid redundancy. Of course, the other coil 2 may also be divided into two portions and arranged in the same manner as the coil 3. In the case where portions that should be heated under the same condition are scattered, the illustrative embodiment makes it needless to assign an exclusive circuit to each portion. This successfully simplifies the circuitry and readily implements an adequate heating condition. A specific example of the illustrative embodiment will be described with reference to FIGS. 13A through 13C.

Figure 13A:
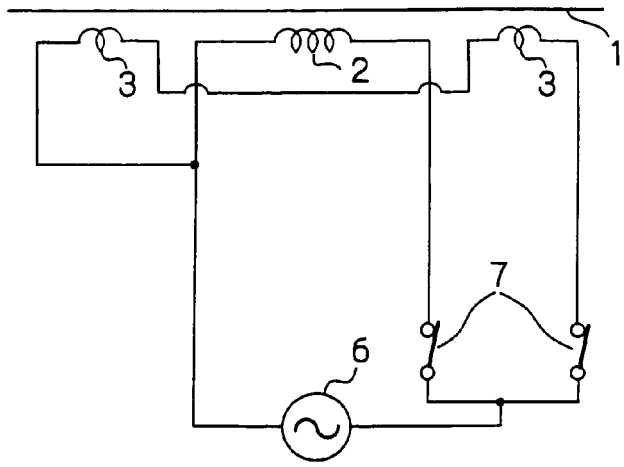
FIG. 13A is a circuit diagram that is a simplified form of the block diagram of FIG. 12.
Figure 13B:
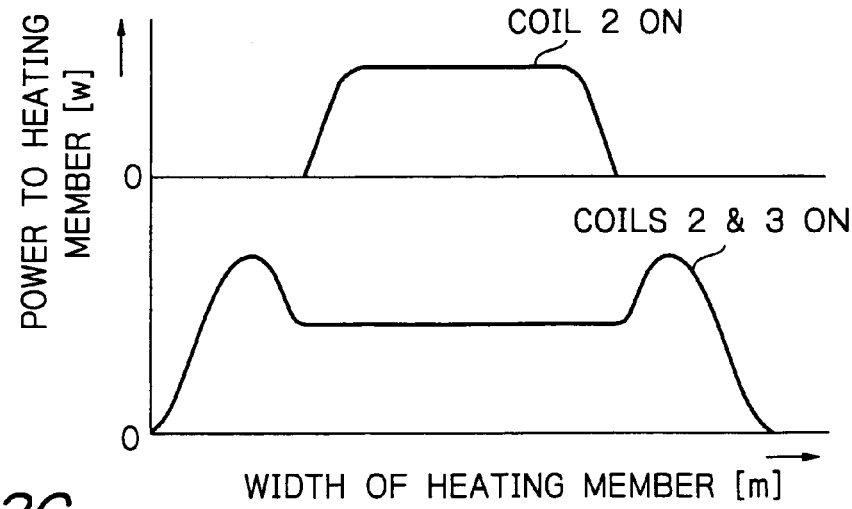
FIGS. 13B and 13C are charts demonstrating a specific operation of the fourth embodiment.
Figure 13C:
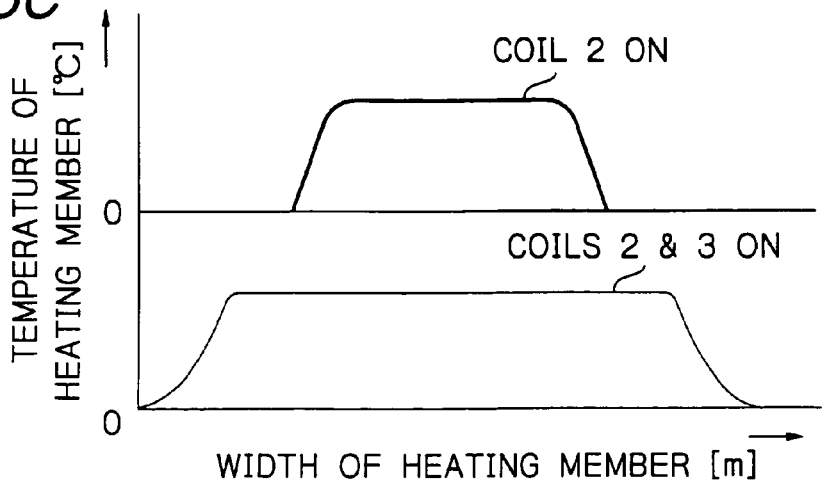

As shown in FIG. 13A, which is a simplified form of the circuitry shown in FIG. 12, the split coil 3 is used when the heating member 1 having ends located at opposite sides should be uniformly heated. In this example, the split portions of the coil 3 are located at the opposite ends of the heating member 1. Power is fed to the induction coils 2 and 3 in a pattern shown in FIG. 13B. As shown, greater power is fed to the coil 3 than to the coil 2 such that the pattern formed by the induction coils 2 and 3 in the widthwise direction of the heating element 1 is higher at the opposite end portions than at the center portion. Despite that such a power pattern causes the heating member 1 to generate more heat at its end portions than at its center portion, the temperature distribution of the heating member 1 is eventually uniformed, as shown in FIG. 13C.

Figure 14:
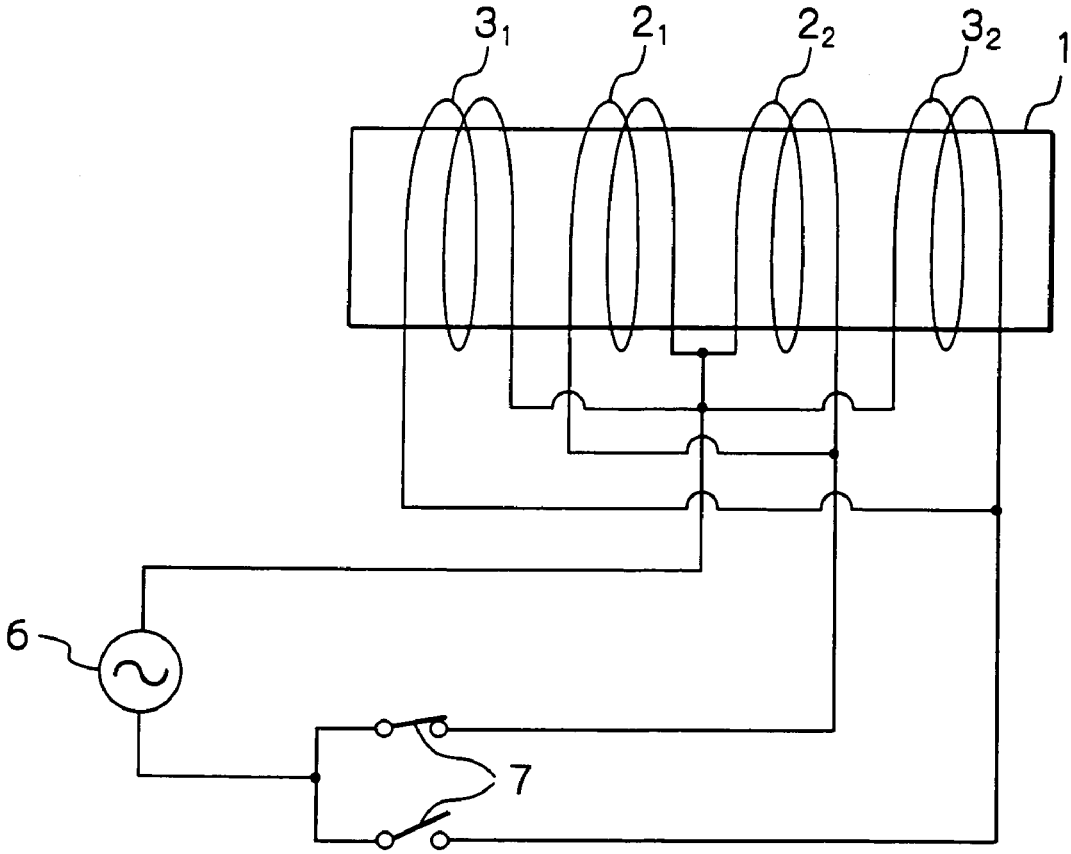
FIG. 14 is a circuit diagram showing a fifth embodiment of the induction heating device in accordance with the present invention including a plurality of groups of induction coils connected in parallel.

FIG. 14 shows a fifth embodiment of the induction heating device in accordance with the present invention also using a split coil arrangement. As shown, the induction heating device includes a heating member 1, induction coils $\mathbf{2}_1$, $\mathbf{2}_2$, $\mathbf{3}_1$ and $\mathbf{3}_2$, an AC power source 6, and switches or switching devices 7. The induction coils $\mathbf{2}_1$ and $\mathbf{2}_2$ and the induction coils $\mathbf{3}_1$ and $\mathbf{3}_2$ each are connected in parallel. The pair of induction coils 21 and 22 and the pair of induction coils 31 and 32 are connected to the AC power source 6 in parallel, so that the power source 6 is fed to each of the coil pairs via one of the switching devices 7. The induction coils $\mathbf{2}_1$ and $\mathbf{2}_2$ and the induction coils $\mathbf{3}_1$ and $\mathbf{3}_2$ are respectively substitutes for the induction coils 2 and 3 shown in FIGS. 7A and 8. When any one of the switches 7 is turned on, a high-frequency current is fed from the AC power source 6 to the split portions of the associated coil, which are located at remote positions on the heating member 1, at the same time in the same phase. Consequently, all the induction coils operate in the same manner as in the first embodiment.

Figure 15:
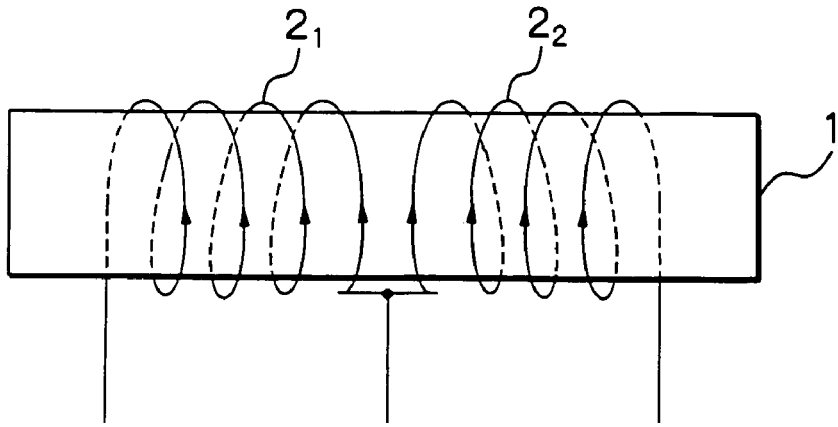
FIG. 15 is a view showing how each induction coil included in the fifth embodiment is turned.

FIG. 15 shows the induction coils $\mathbf{2}_1$ and $\mathbf{2}_2$ in detail. As shown, to make a heat distribution symmetric with respect to the center, the induction coils $\mathbf{2}_1$ and $\mathbf{2}_2$ are turned in opposite directions from the center to the right and left. This configuration prevents magnetic fluxes form canceling each other and allows a winding to be formed with its center used as a reference. Such a winding is easy to handle and promotes efficient work.

Only the induction coils $\mathbf{2}_1$ and $\mathbf{2}_2$ or the induction coils $\mathbf{3}_1$ and $\mathbf{3}_2$ may be arranged in a split configuration, depending on a desired heat distribution. Of course, the four induction coils $\mathbf{2}_1$ through $\mathbf{3}_2$ may be replaced with five or more induction coils.

Figure 16:
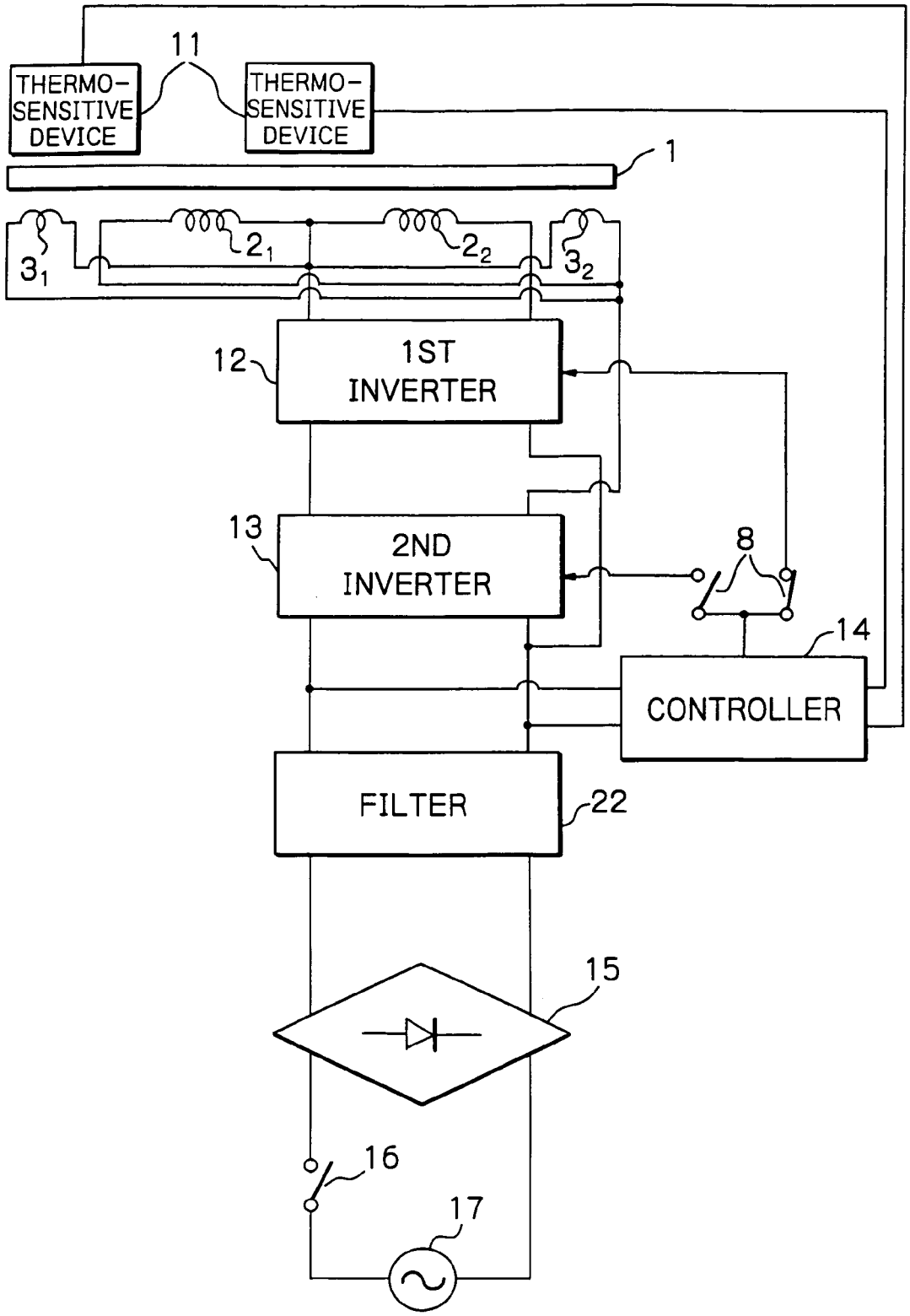
FIG. 16 is a schematic block diagram showing a sixth embodiment of the induction heating device in accordance with the present invention using the groups of coils of FIG. 14.

FIG. 16 shows a sixth embodiment of the induction heating device in accordance with the present invention. As shown, the induction heating device includes a heating member 1, induction coils $\mathbf{2}_1$ and $\mathbf{2}_2$ connected in parallel, induction coils $\mathbf{3}_1$ and $\mathbf{3}_2$ connected in parallel, switching devices or switches 8, thermosensitive devices 11, a first and a second inverter 12 and 13, a controller 14, a switch 16, an AC power source 17, and a filter 22. The inverters 12 and 13 drive the pair of induct ion coils $\mathbf{2}_1$ and $\mathbf{2}_2$ and the pair of induction coils $\mathbf{3}_1$ and $\mathbf{3}_2$ respectively. That is, the induction coils $\mathbf{2}_1$ and $\mathbf{2}_2$ and induction coils $\mathbf{3}_1$ and $\mathbf{3}_2$ are respectively substitutes for the induction coils 2 and 3 shown in FIG. 10.

In the illustrative embodiment, when any one of the switching devices 8 is turned on, the induction coils located at remote positions on the heating member 1 receive a high-frequency current via the shared inverter at the same time in the same phase. Consequently, all the induction coils operate in the same manner as in the fifth embodiment described with reference to FIGS. 14 and 15. Further, the inverters 12 and 13 to which the heating condition of the heating member 1 is fed back controllably drive the pair of induction coils $\mathbf{2}_1$ and $\mathbf{2}_2$ and the pair of induction coils $\mathbf{3}_1$ and $\mathbf{3}_2$ in the same manner as in the second embodiment (FIG. 10).

Figure 17:
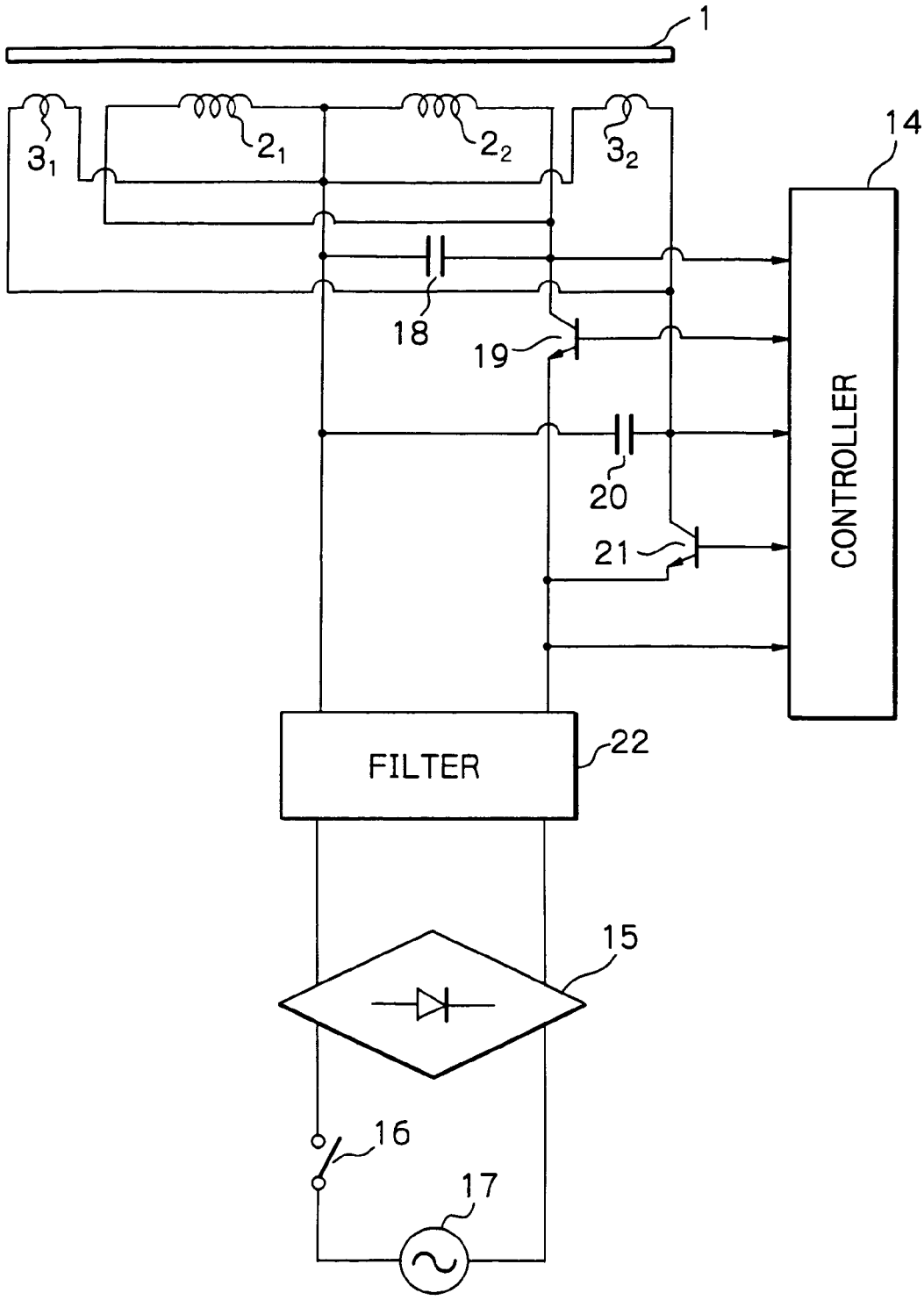
FIG. 17 is a schematic block diagram showing a seventh embodiment of the induction heating device in accordance with the present invention also using the groups of coils of FIG. 14.

FIG. 17 shows a seventh embodiment of the induction heating device in accordance with the present invention. As shown, the induction heating device includes a heating member 1, induction coils $\mathbf{2}_1$ and $\mathbf{2}_2$ connected in parallel, induction coils $\mathbf{3}_1$ and $\mathbf{3}_2$ connected in parallel, a controller 14, a rectifier 15, a switch 16, an AC power source 17, a first and a second capacitor 18 and 20, a first and a second main switching device 19 and 21, and a filter 22. Inverters are controlled by the controller 14 independently of each other and, in turn, respectively drive the pair of induction coils $\mathbf{2}_1$ and $\mathbf{2}_2$ and the pair of induction coils $\mathbf{3}_1$ and $\mathbf{3}_2$ and the capacitors 18 and 20 connected to the coil pairs in parallel. That is, the induction coils $2_1$ and $2_2$ and induction coils $3_1$ and $3_2$ are respectively substitutes for the induction coils 2 and 3 shown in FIG. 11.

When any one of the main switching devices 19 and 21 is turned on, the induction coils located at remote positions on the heating member 1 in a pair receive a high-frequency current via the shared inverter at the same time in the same phase. Consequently, all the induction coils operate in the same manner as in the fifth embodiment described with reference to FIGS. 14 and 15. Further, the inverters controlled by the controller 14 independently of each other respectively drive the capacitors 18 and 20 in the same manner as in the third embodiment (FIG. 11).

Either the induction coils $2_1$ and $2_2$ or the induction coils $3_1$ and $3_2$ may be connected in series, if desired. Again, the circuitry may include any desired number of induction coils. Further, the circuitry may additionally include a trigger sensing circuit and a protection circuit.

Figure 18:
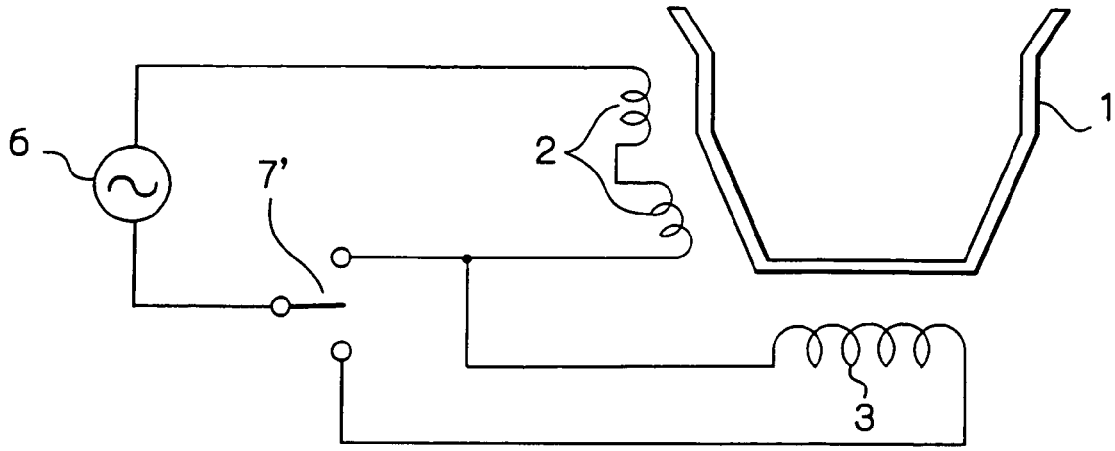
FIGS. 18 and 19 are circuit diagrams showing an eighth embodiment of the induction heating device in accordance with the present invention.
Figure 19:
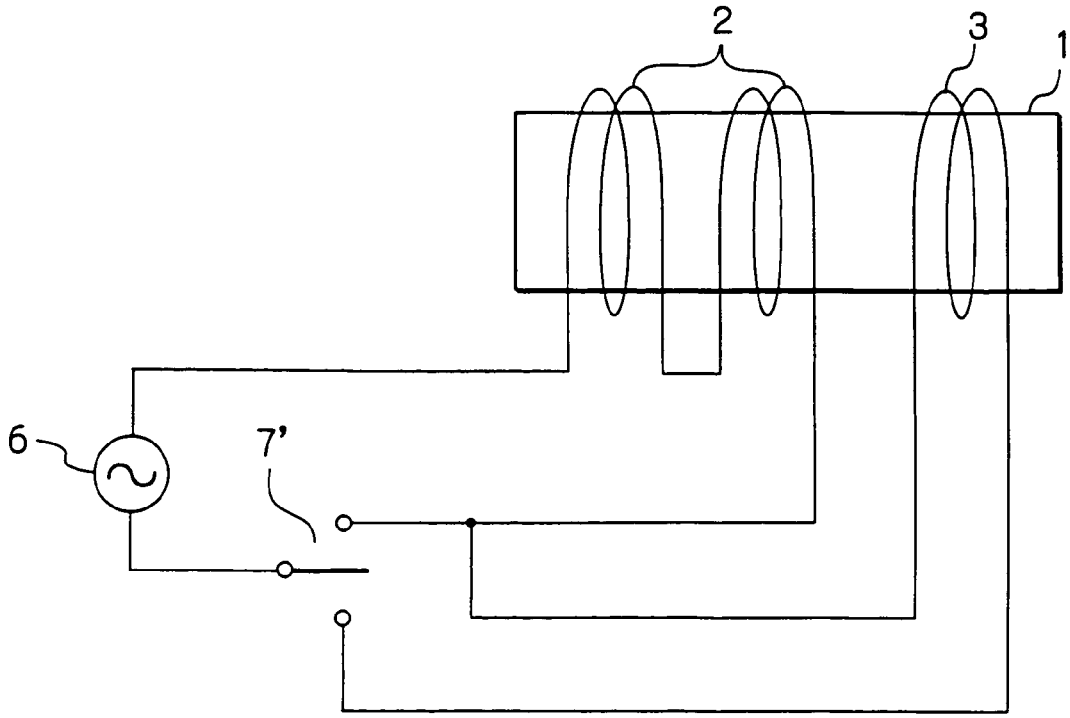

FIGS. 18 and 19 show an eighth embodiment of the induction heating device in accordance with the present invention. As shown, the induction heating device includes a heating member 1, induction coils 2 and 3, an AC power source 6, and a switch or switching device 7' including an intermediate tap. The switch or switching device 7' is selectively operated to connect the AC power source 6 only to the induction coil 2 or to both of the induction coils 2 and 3 connected in series. Therefore, when the switch 7' is so operated to drive both of the serially connected induction coils 2 and 3, a high-frequency current is fed from the AC power source 6 to the induction coils 2 and 3. As a result, currents flow through the induction coils 2 and 3 at the same time in the same phase.

The illustrative embodiment is basically identical with the first embodiment in that it switches the drive of a plurality of induction coils so arranged as to heat remote portions or part of the heating member 1 and varies a heat pattern, which occurs in the heating member 1 as a result of heat induction. In this sense, the illustrative embodiment shares the same field of application, as well as the specific example shown in FIGS. 9A and 9B, with the first embodiment.

Further, in the illustrative embodiment, a single inverter selectively feeds a high-frequency current to only part of or all of the induction coils connected in series. The illustrative embodiment therefore achieves the following advantages (1) through (4).

(1) The inverter is free from interference.

(2) Irregular heating is reduced.

(3) A certain degree of change in the dimension of a heating range or that of an object to be heated can be readily coped with.

(4) Two main switches, constituting the inverter, can control power coil by coil.

The induction heating device with the above advantages (1) through (4) has an energy saving, reliable and miniature configuration.

Figure 20:
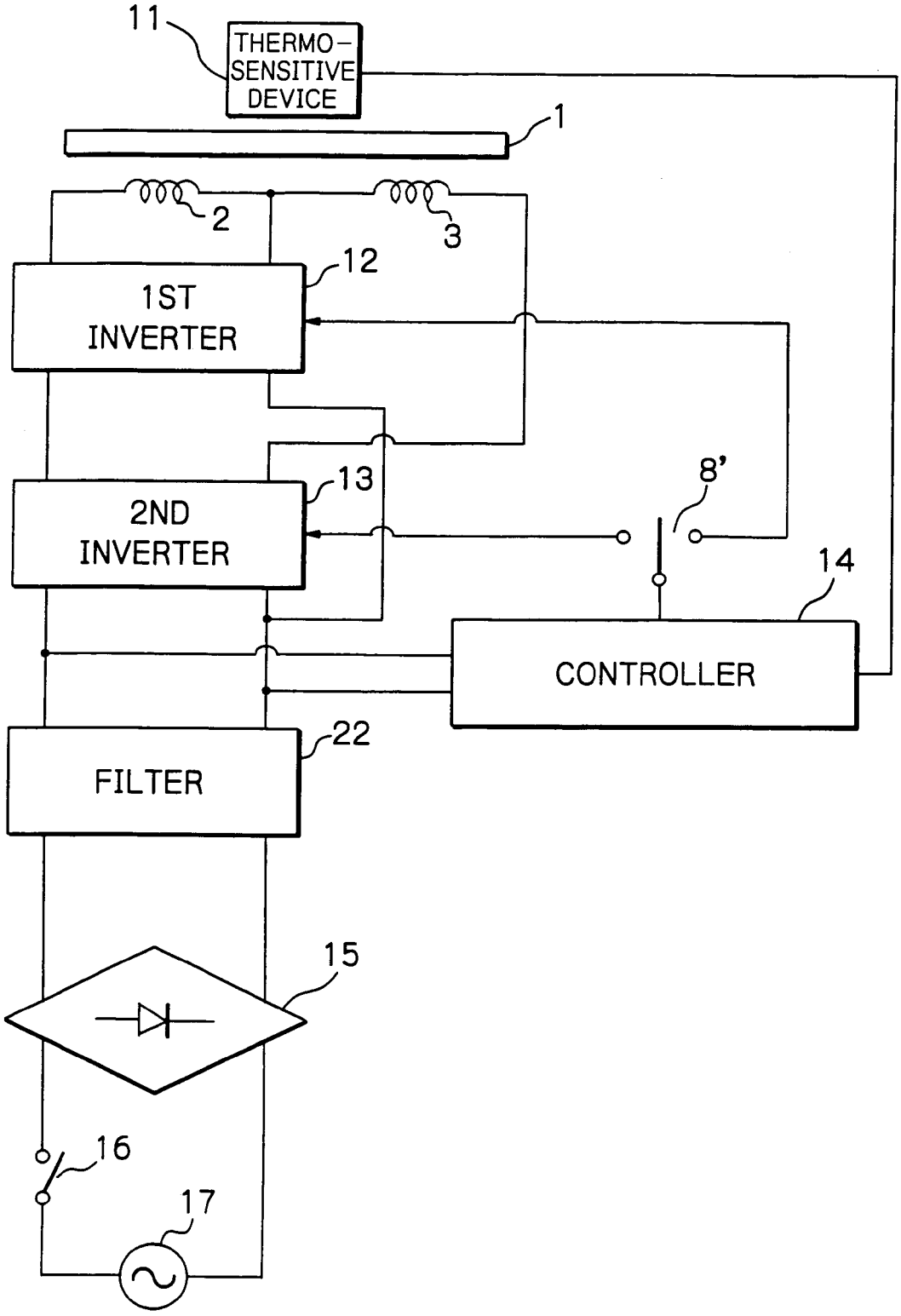
FIG. 20 is a schematic block diagram showing a ninth embodiment of the induction heating device in accordance with the present invention including inverters.

FIG. 20 shows a ninth embodiment of the induction heating device in accordance with the present invention. As shown, the induction heating device includes a heating member 1, serially connected induction coils 2 and 3, a switching device or switch 8', a thermosensitive device 11, a first and a second inverter 12 and 13, a controller 14, a switch 16, an AC power source 17, and a filter 22. The illustrative embodiment, like the eighth embodiment, can selectively feed a high-frequency current only to the coil 2 or to both of the induction coils 2 and 3.

In the illustrative embodiment, when only the coil 2 should be driven, the first inverter 12 feeds the high-frequency current. When the induction coils 2 and 3 both should be driven, the second inverter 13 feeds the current. The switching device 8' switches the inverters 12 and 13 for such selective feed of the current to the induction coils 12 and 13. The controller 14 controls the switching device 8' in accordance with signals generated within the circuitry and including the output of the photosensitive device 11 and signals input from outside the circuitry. The AC power source 17, switch 16, rectifier 15 and filter 22 constitute an input circuit connected to the inputs of the inverters 12 and 13. If desired, the circuitry may include three or more inverters and may additionally include a trigger sensing circuit and a protection circuit.

The illustrative embodiment allows the inverters 12 and 13 to be switched in a low voltage, small current portion and can therefore use small-capacity switching devices or switches. This implements a small size, low cost configuration and reduces a switching loss.

Figure 21:
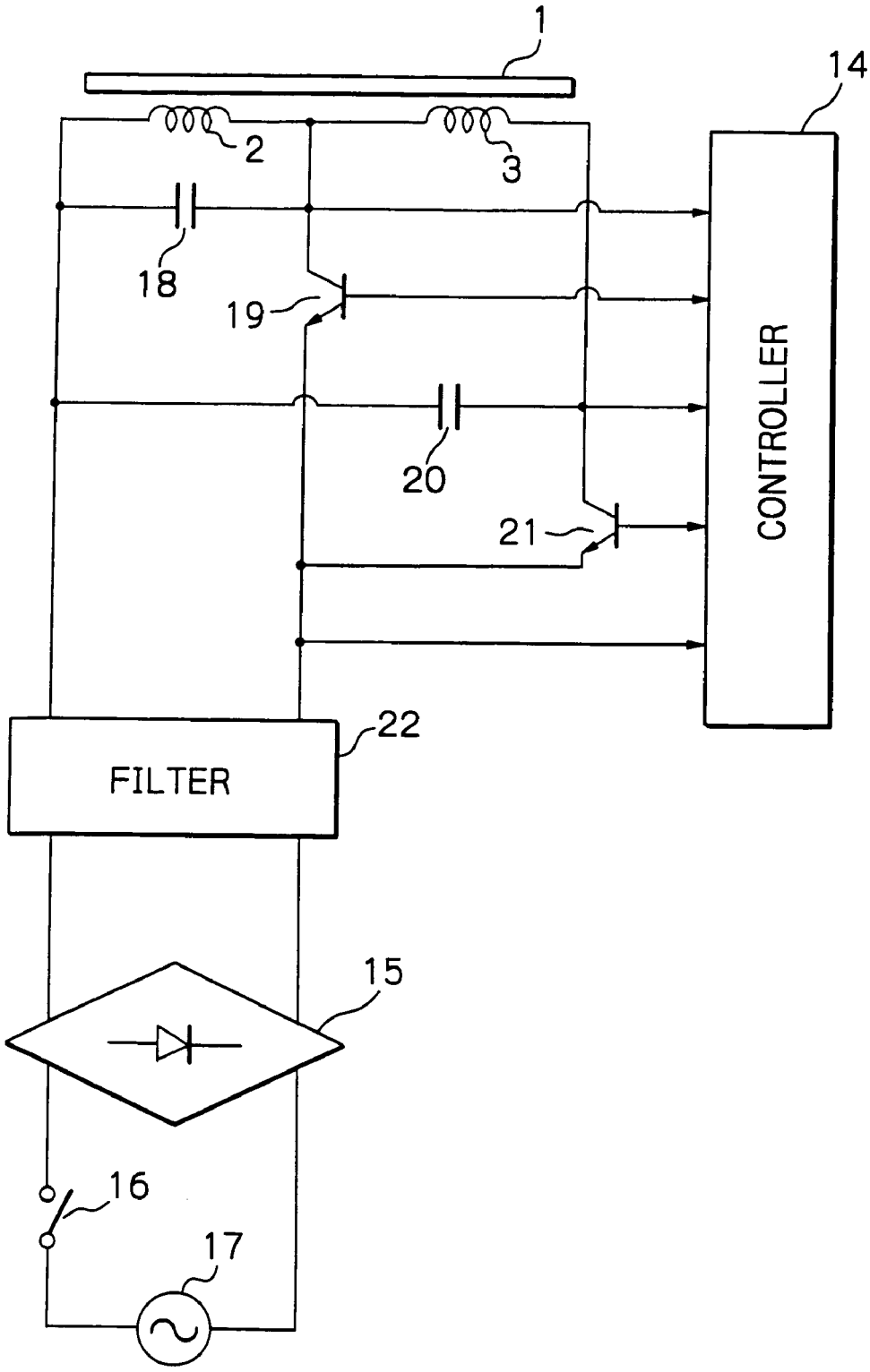
FIG. 21 is a schematic block diagram showing a tenth embodiment of the induction heating device in accordance with the present invention including induction coils to which capacitors are connected in parallel.

FIG. 21 shows a tenth embodiment of the induction heating device in accordance with the present invention. As shown, the induction heating device includes induction coils 2 and 3 connected in series, a controller 14, a rectifier 15, a switch 16, an AC power source 17, a first and a second capacitor 18 and 20, a first and a second main switching device 19 and 21, and a filter 22. The illustrative embodiment, like the ninth embodiment, can selectively feed a high-frequency current only to the coil 2 or to both of the induction coils 2 and 3.

In the illustrative embodiment, the AC power source 17, switch 16, rectifier 15 and filter 22 constitute a shared input circuit. The first main switching device 19 controls the feed of the high-frequency current only to the coil 2 while the second main switching device 21 controls the feed of the current to both of the induction coils 2 and 3. The input circuit and main switching devices 19 and 20 constitute inverters in combination. Each inverter controls the operation of one of the coil 2 and capacitor 18 connected thereto in parallel and the induction coils 2 and 3 and capacitor 20 connected thereto in parallel. The main switching devices 19 and 21 may be implemented by transistors and perform switching operations under the control of the controller 14. The operating condition of the induction coils is fed back to the controller 14. The circuitry may additionally include a protection circuit, if desired.

The illustrative embodiment extends the range over which the inductance of the induction coils 2 and 3 is adjustable and therefore the range over which power to be fed is adjustable.

Figure 22:
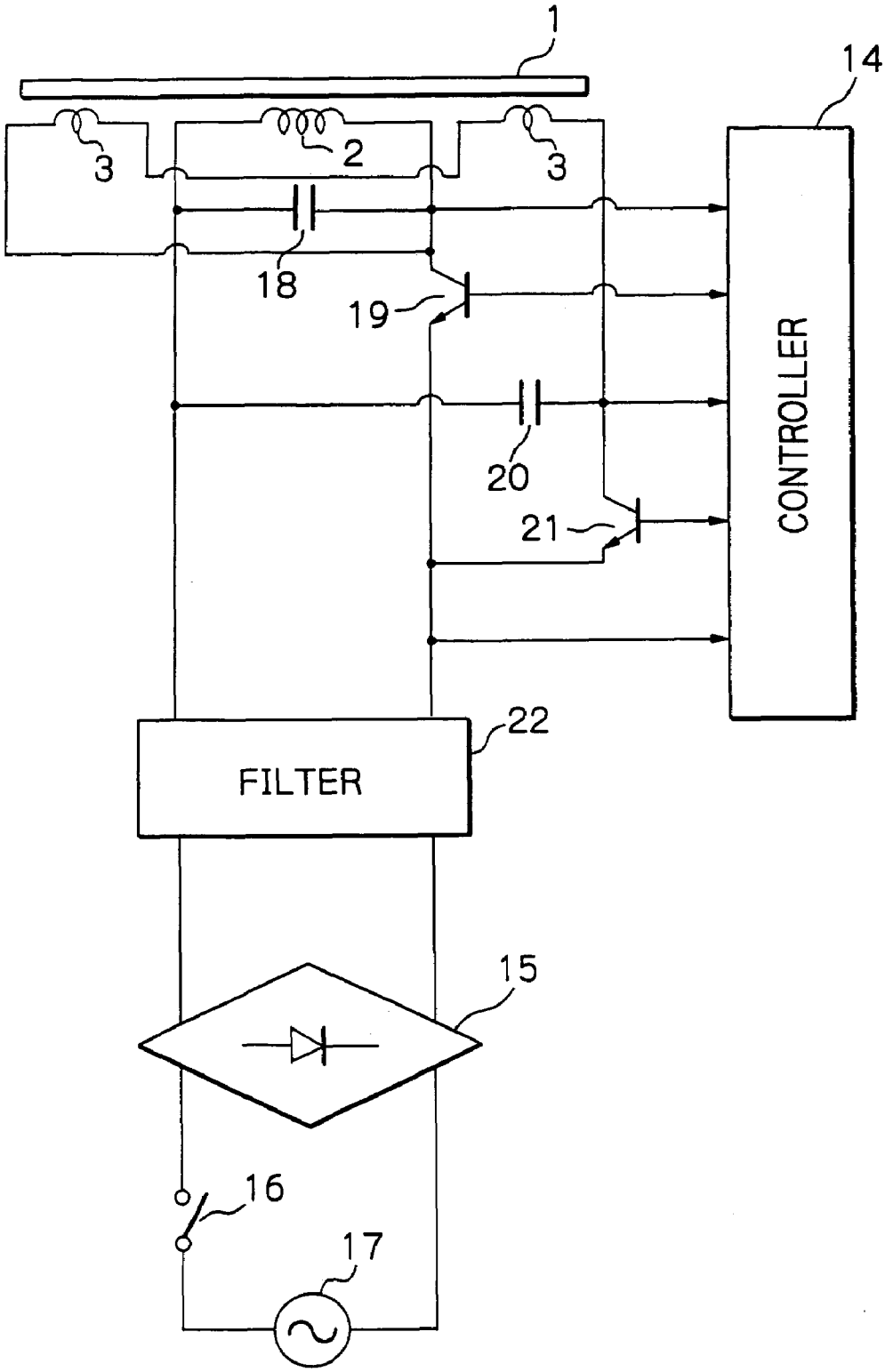
FIG. 22 is a schematic block diagram showing an eleventh embodiment of the induction heating device in accordance with the present invention including split induction coils.

FIG. 22 shows an eleventh embodiment of the induction heating device in accordance with the present invention. As shown, this embodiment is identical with the tenth embodiment (FIG. 21) except that the induction coil 3 is made up of two portions remote from each other. Structural elements identical with the structural elements of the tenth embodiment are designated by identical reference numerals and will not be described in order to avoid redundancy. The split arrangement may be similarly applied to the induction coil 2 also, if desired.

In the case where portions that should be heated under the same condition are scattered, the illustrative embodiment makes it needless to assign an exclusive circuit to each portion. This successfully simplifies the circuitry and readily implements an adequate heating condition. A specific example of the illustrative embodiment will be described with reference to FIGS. 23A through 23C.

Figure 23A:
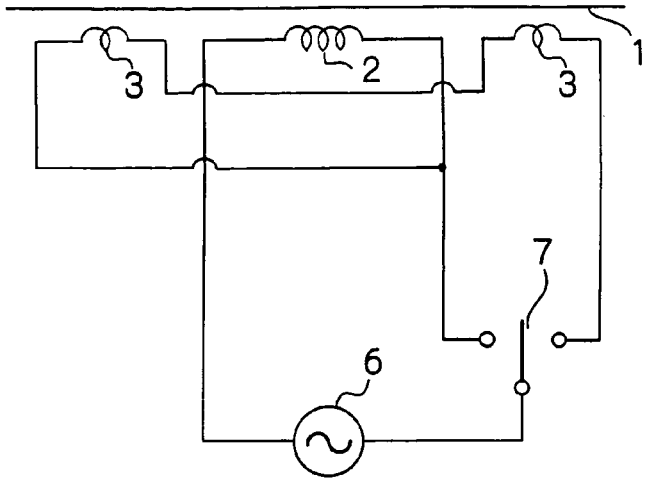
FIG. 23A is a circuit diagram showing a simplified form of the block diagram of FIG. 22.
Figure 23B:
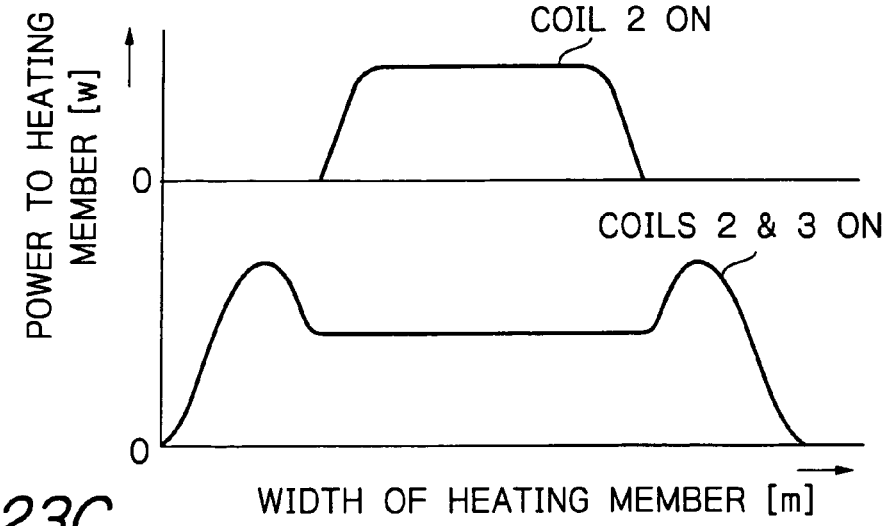
FIGS. 23B and 23C are charts representative of a specific operation of the eleventh embodiment.
Figure 23C:
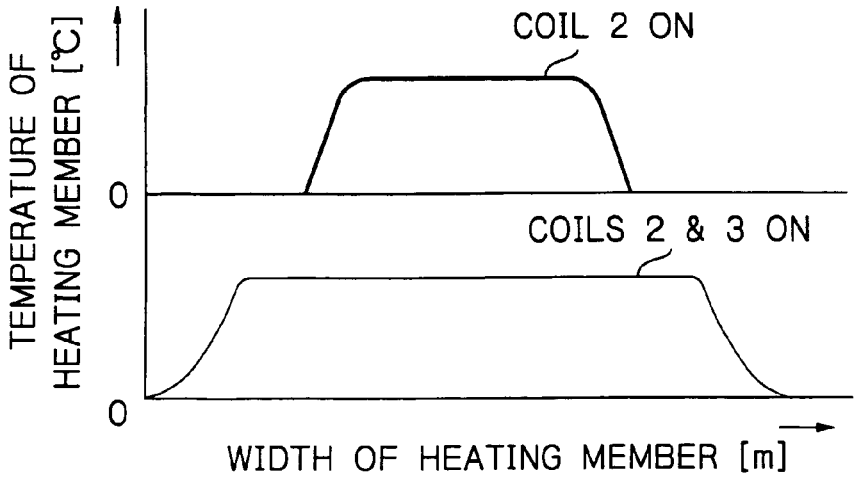

As shown in FIG. 23A, which is a simplified form of the circuitry shown in FIG. 22, the split induction coil 3 is used when the heating member 1 having ends located at opposite sides should be uniformly heated. In this example, the split portions of the induction coil 3 are located at the opposite ends of the heating member 1. Power is fed to the induction coils 2 and 3 in a pattern shown in FIG. 23B. As shown, greater power is fed to the coil 3 than to the coil 2 such that the pattern formed by the induction coils 2 and 3 in the widthwise direction of the heating element 1 is higher at the opposite end portions than at the center portion. Despite that such a power pattern causes the heating member 1 to generate heat more at its end portions than at its center portion, the temperature distribution of the heating member 1 is eventually uniformed, as shown in FIG. 23C.

Figure 24:
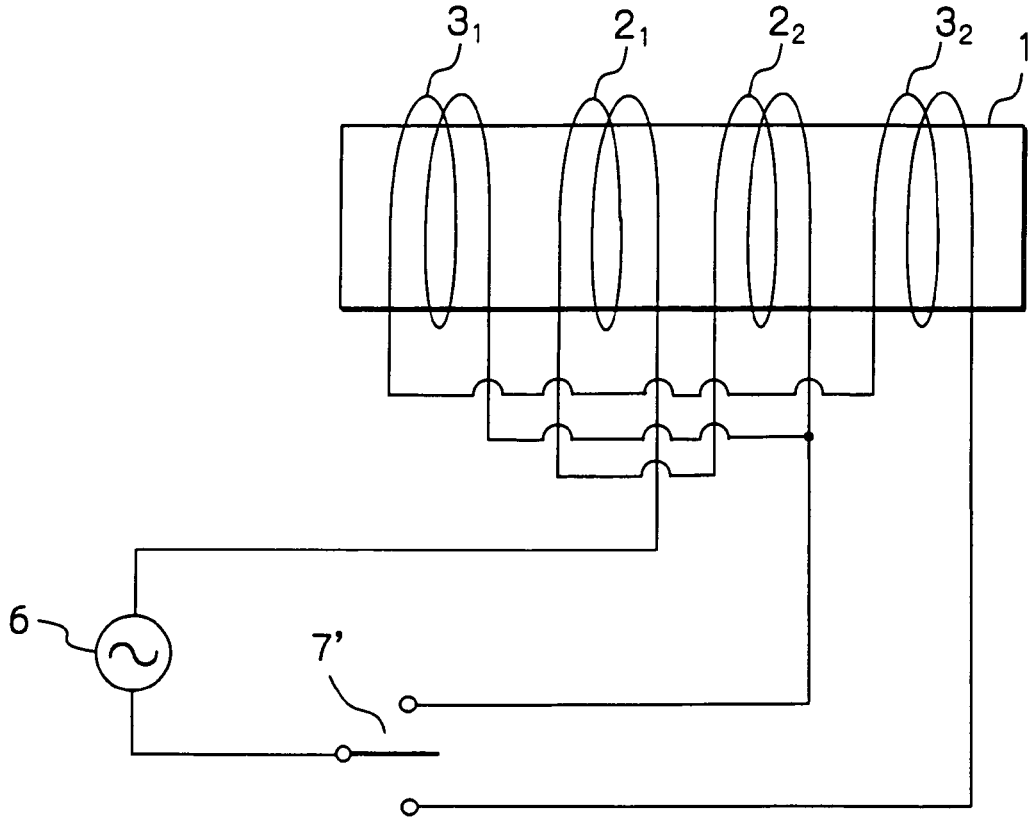
FIG. 24 is a circuit diagram showing a twelfth embodiment of the induction heating device in accordance with the present invention including groups of coils connected in series.

FIG. 24 shows a twelfth embodiment of the induction heating device in accordance with the present invention. As shown, the induction heating device includes a heating member 1, induction coils $\mathbf{2}_1$, $\mathbf{2}_2$, $\mathbf{3}_1$ and $\mathbf{3}_2$, an AC power source 6, and a switch or switching device 7'. The induction coils $\mathbf{2}_1$ and $\mathbf{2}_2$ connected in series and the induction coils $\mathbf{3}_1$ and $\mathbf{3}_2$ also connected in series are serially connected to the AC power source 6 via a tap positioned intermediate between the coil pairs. The AC power source 6 is selectively connectable only to the induction coils $\mathbf{2}_1$ and $\mathbf{2}_2$ or to both of the induction coils $\mathbf{2}_1$ and $\mathbf{2}_2$ and induction coils $\mathbf{3}_1$ and $\mathbf{3}_2$ via the switch or switching device 7'. Therefore, when the switch 7' is so operated as to drive both of the serially connected induction coils $\mathbf{2}_1$ and $\mathbf{2}_2$ and induction coils $\mathbf{3}_1$ and $\mathbf{3}_2$, a high-frequency current is fed from the AC power source 6 to the induction coils $\mathbf{2}_1$ through $\mathbf{3}_2$. As a result, currents flow through the induction coils $\mathbf{2}_1$ through $\mathbf{3}_2$ at the same time in the same phase. Consequently, all the induction coils operate in the same manner as in the eighth embodiment.

Figure 25:
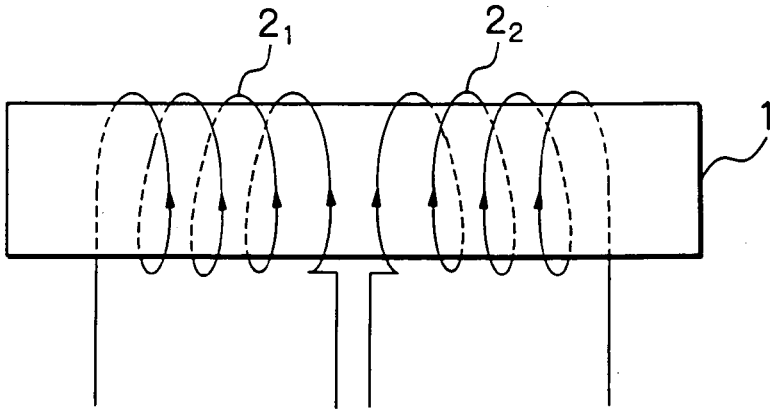
FIG. 25 is a view showing how each induction coil of FIG. 24 is turned.

FIG. 25 shows only the induction coils $\mathbf{2}_1$ and $\mathbf{2}_2$ in detail by way of example. As shown, to make a heat distribution symmetric with respect to the center, the induction coils $\mathbf{2}_1$ and $\mathbf{2}_2$ are turned in opposite directions from the center to the right and left. This configuration prevents magnetic fluxes form canceling each other and allows a winding to be formed with its center used as a reference. Such a winding is easy to handle and promotes efficient work. Only the induction coils $\mathbf{2}_1$ and $\mathbf{2}_2$ or the induction coils $\mathbf{3}_1$ and $\mathbf{3}_2$ may be arranged in a split configuration, depending on a desired heat distribution.

Figure 26:
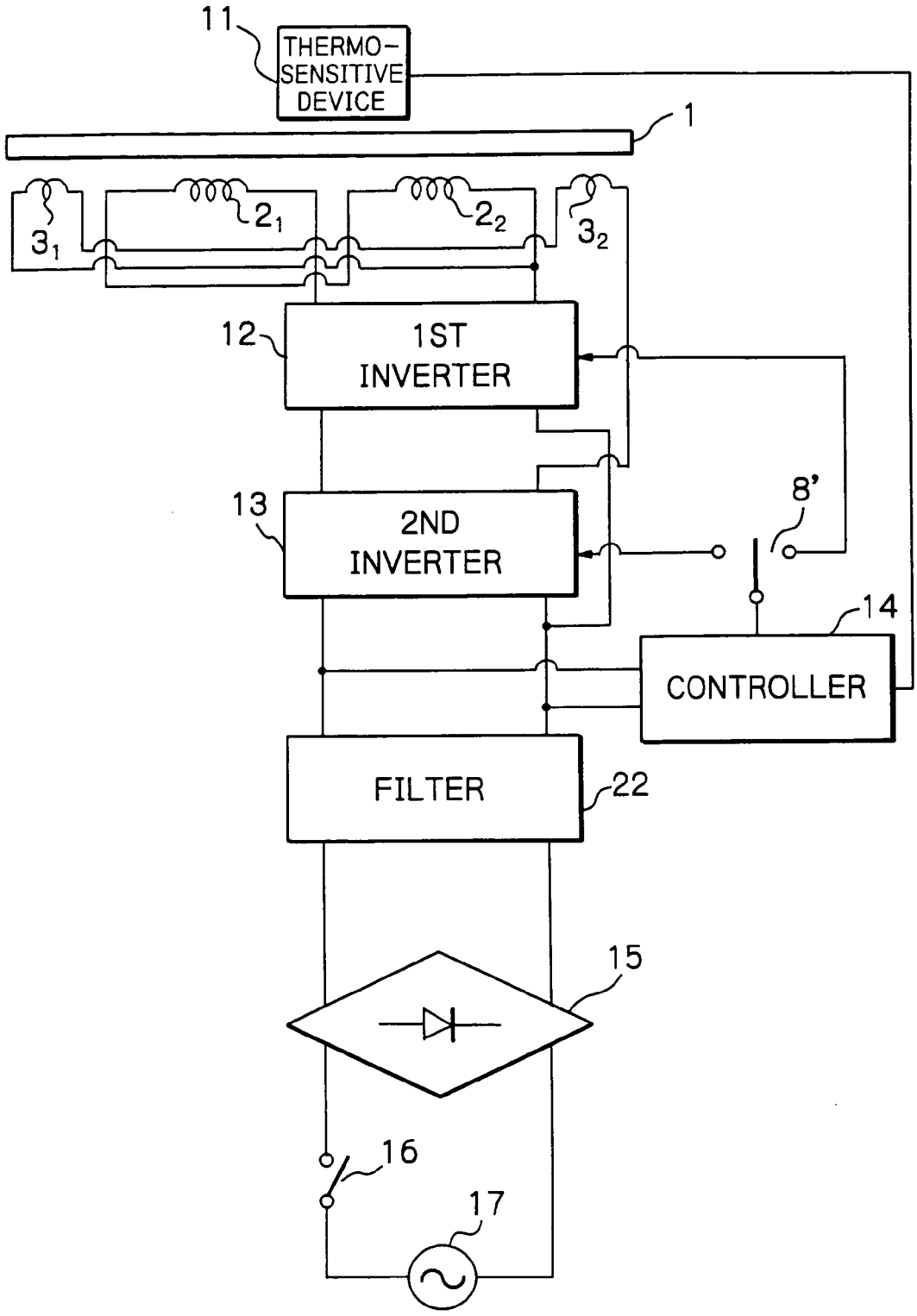
FIG. 26 is a schematic block diagram showing a thirteenth embodiment of the induction heating device in accordance with the present invention using the groups of coils of FIG. 24.

FIG. 26 shows a thirteenth embodiment of the induction heating device in accordance with the present invention. As shown, the induction heating device includes a heating member 1, induction coils $\mathbf{2}_1$ and $\mathbf{2}_2$ connected in series, induction coils $\mathbf{3}_1$ and $\mathbf{3}_2$ connected in series, a switching device or switch 8', a thermosensitive device 11, a first and a second inverter 12 and 13, a controller 14, a rectifier 15, a switch 16, an AC power source 17, and a filter 22. The inverter 12 drives only the induction coils $\mathbf{2}_1$ and $\mathbf{2}_2$ while the inverter 13 drives all of the induction coils $\mathbf{2}_1$, $\mathbf{2}_2$, $\mathbf{3}_1$ and $\mathbf{3}_2$. That is, the induction coils $\mathbf{2}_1$ and $\mathbf{2}_2$ and the induction coils $\mathbf{3}_1$ and $\mathbf{3}_2$ are respectively substitutes for the induction coils 2 and 3 shown in FIG. 20.

In this configuration, to drive both of the pair of induction coils $\mathbf{2}_1$ and $\mathbf{2}_2$ and the pair of induction coils $\mathbf{3}_1$ and $\mathbf{3}_2$, the inverters 12 and 13 feed a high-frequency current to the induction coils at the same time in the same phase. Consequently, the two pairs of induction coils operate in the same manner as in the twelfth embodiment. Further, the inverters 12 and 13 to which the heating condition of the heating member 1 is fed back control the pair of induction coils $\mathbf{2}_1$ and $\mathbf{2}_2$ and the pair of induction coils 31 and 32, respectively. Therefore, the circuitry operates in the same manner as in the ninth embodiment.

A fourteenth embodiment of the induction heating device in accordance with the present invention will be described with reference to FIG. 27. As shown, the induction heating device includes a heating member 1, induction coils $\mathbf{2}_1$ and $\mathbf{2}_2$ connected in series, induction coils $\mathbf{3}_1$ and $\mathbf{3}_2$ connected in series, a controller 14, a rectifier 15, a switch 16, an AC power source 17, a first and a second capacitor 18 and 20, a first and a second main switching device 19 and 21, and a filter 22. The capacitor 18 is connected to the pair of induction coils $\mathbf{2}_1$ and $\mathbf{2}_2$ in parallel. The capacitor 18 is connected to the pair of induction coils $\mathbf{2}_1$ and $\mathbf{2}_2$ and the pair of induction coils $\mathbf{3}_1$ and $\mathbf{3}_2$ in parallel. The inverters are controlled by the controller 14 independently of each other and, in turn, respectively drive the induction coils $\mathbf{2}_1$ and $\mathbf{2}_2$ and capacitor 18 and the induction coils $\mathbf{3}_1$ and $\mathbf{3}_2$ and capacitor 20. That is, the induction coils $\mathbf{2}_1$ and $\mathbf{2}_2$ and induction coils $\mathbf{3}_1$ and 32 are respectively substitutes for the induction coils 2 and 3 shown in FIG. 21.

In the above configuration, when any one of the main switches 19 and 21 is turned on, the associated inverter feeds a high-frequency current to the induction coils 21 and 22 or the induction coils 31 and 32 remote from each other at the same time in the same phase. Consequently, the two pairs of induction coils operate in the same manner as in the twelfth embodiment. Further, the inverters, which are controlled by the controller 14 independently of each other, respectively drive the capacitors 18 and 20 respectively connected to the induction coils $\mathbf{2}_1$ and $\mathbf{2}_2$ and to the induction coils $\mathbf{2}_1$, $\mathbf{2}_2$, $\mathbf{3}_1$ and $\mathbf{3}_2$. Therefore, the circuitry operates in the same manner as in the tenth embodiment.

Figure 27:
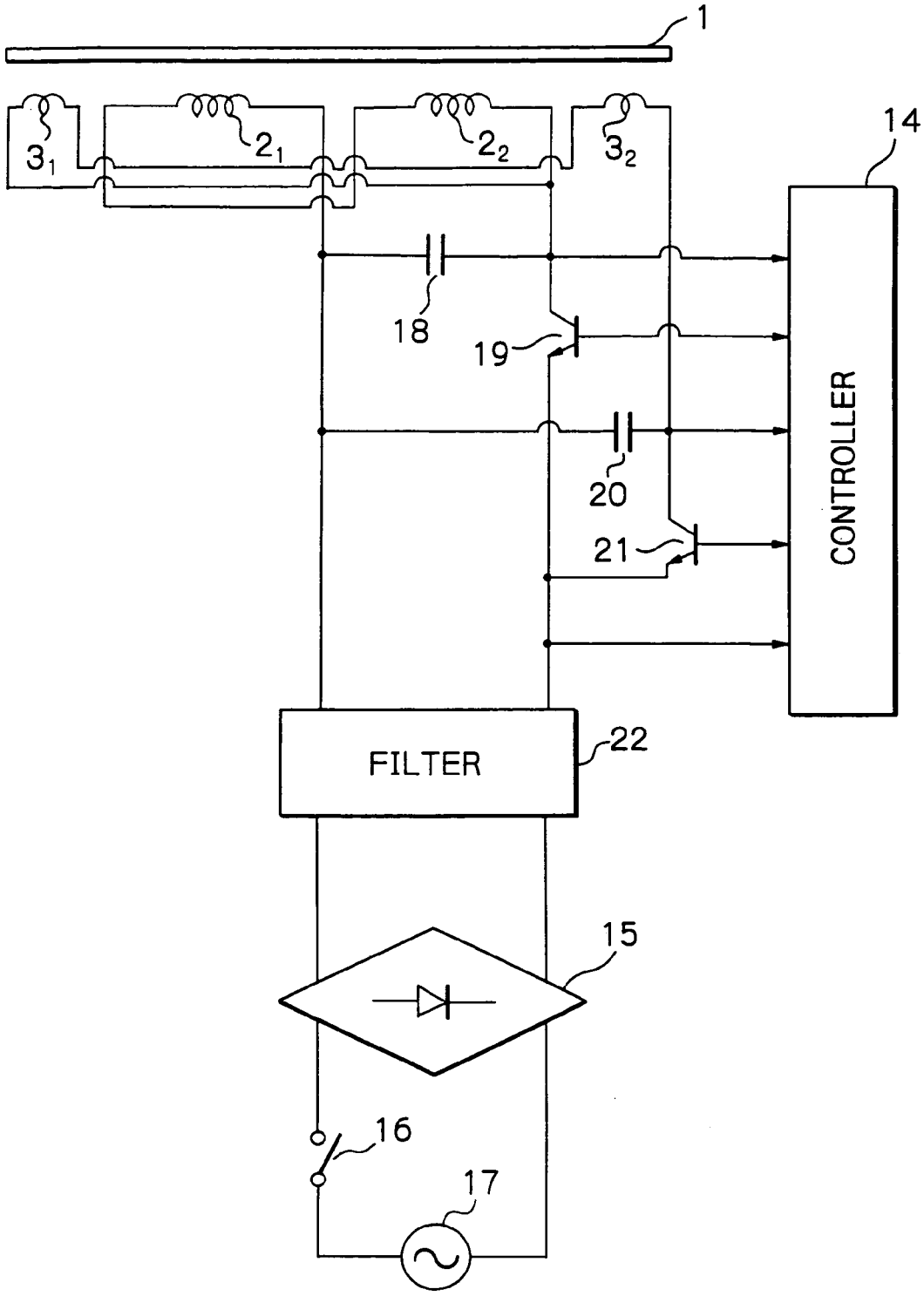
FIG. 27 is a schematic block diagram showing a fourteenth embodiment of the induction heating device in accordance with the present invention also using the groups of coils of FIG. 24.

It is to be noted that the circuitry shown in FIG. 27 may included any desired number of induction coils and may additionally include a protection circuit.

Figure 28:
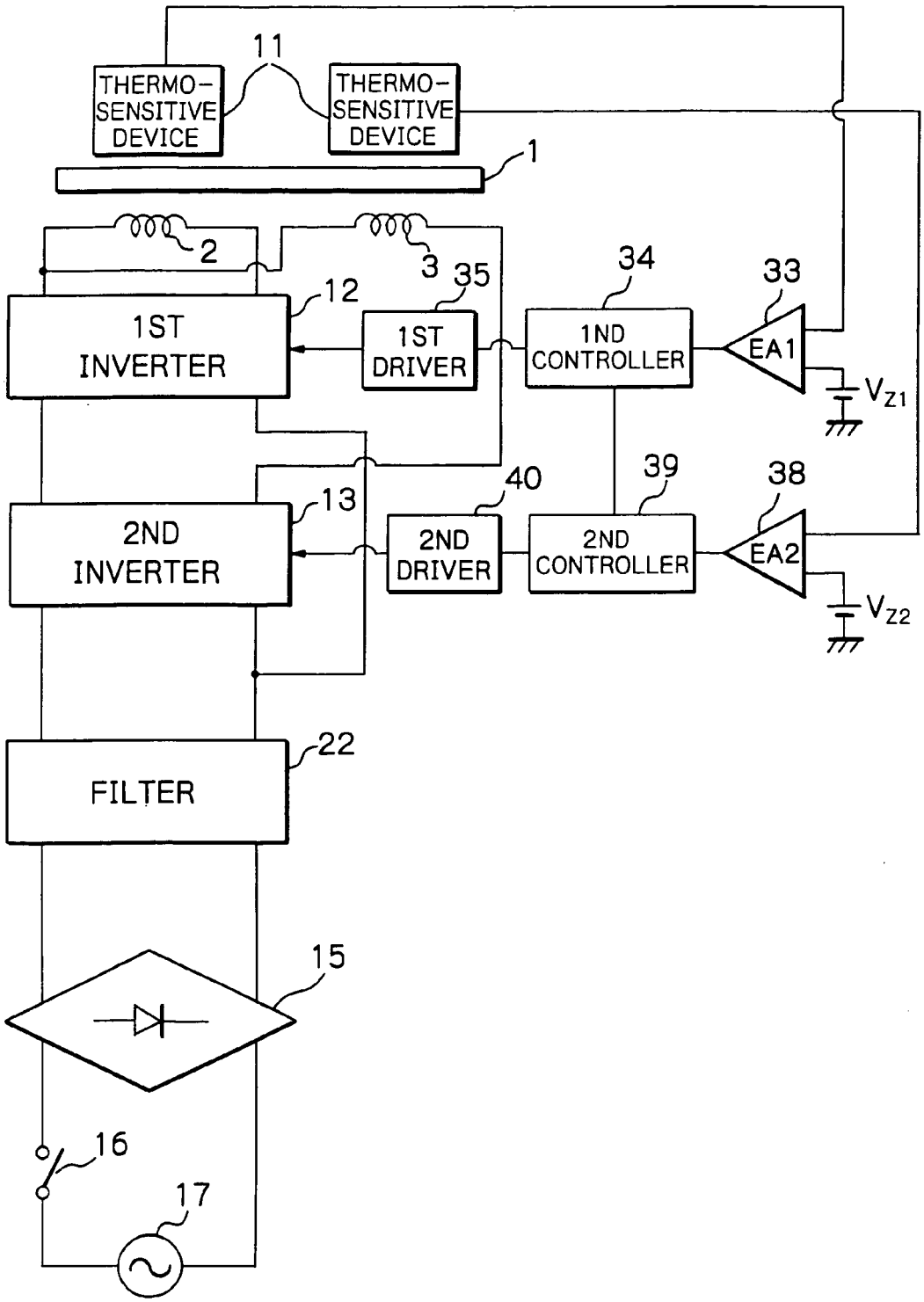
FIG. 28 is a schematic block diagram showing a fifteenth embodiment of the induction heating device in accordance with the present invention using a switching power source that executes thin-down control.

Reference will be made to FIG. 28 for describing a fifteenth embodiment of the induction heating device in accordance with the present invention constructed to execute thin-down control. As shown, the induction heating device includes a heating member 1, induction coils 2 and 3, thermosensitive devices 11, a switch 16, an AC power source 17, a filter 22, a first and a second error amplifier (EA1 and EA2) 33 and 38, a controller 34, a thin-down controller 39, and a first and a second driver 35 and 40.

The controller 34 controls the first driver 35 on the basis of a variable ON or OFF width and thereby drives the first inverter 12, so that a high-frequency current is fed to the induction coil 2. On the other hand, the thin-down controller 39 thins down a signal synchronous to a variable ON/OFF width control signal output from the controller 34, thereby outputting a control signal for driving the second inverter 13. As a result, a high-frequency current is fed to the induction coil 3. More specifically, to drive both of the induction coils 2 and 3, the coil 3 is caused to turn on in synchronism with the turn-on of the induction coil 2. To drive the induction coil 2 only, the induction coil 3 is prevented from turning on in cynchronism with the turn-on of the induction coil 2.

The thermosensitive devices 11 each are responsive to the temperature of the heating member 1 heated by the induction coils 2 and 3. Reference voltages Vz1 and Vz2 are assigned to the first and second error amplifiers 33 and 38, respectively. Control circuitry is constructed to feed back the outputs of the thermosensitive devices 1 via the error amplifiers 33 and 38. By assigning a particular temperature to each of the reference voltages Vz1 and Vz2, the control circuitry can control the temperature of the heating member 1 to either one of the above temperatures.

In the illustrative embodiment, the controller 34 and thin-down controller 29 feed control signals to the drivers 35 and 10, respectively. In response, the drivers 35 and 40 respectively turn on or turn off the inverters 12 and 13 in a low voltage, small current portion. The illustrative embodiment can therefore use small-capacity switching devices or switches. Moreover, the inverters operate in a resonance system and makes the circuitry small size and low cost. In addition, the circuitry efficiently operates with a minimum of switching loss.

If desired, the inverters 12 and 13 each may be turned on and turned off in accordance with signals input from outside the circuitry shown in FIG. 28. The two inverters 12 and 13 are only illustrative and may be replaced with any other suitable number of inverters. Also, the two thermosensitive devices 11 may be replaced with any other suitable number of thermosensitive devices. The circuitry may additionally include a trigger sensing circuit and a protection circuit, as needed.

The illustrative embodiments shown and described each include control circuitry, which includes a feedback circuit, for controllably switching the converters or inverters. Such control circuitry may be implemented as a digital processing system that performs digital operations. An IC (Integrated Circuit) is applicable to the digital processing system for insuring highly accurate, stable control. It follows that the switching power sources and induction heating devices each have an energy saving, highly reliable, small size and low cost configuration.

Generally, in a copier, facsimile apparatus or similar electrophotographic image processing apparatus, a toner image formed on a paper sheet or similar recording medium is fixed by a heat roller. The prerequisite with the heat roller is that part thereof expected to contact the recording medium be held at an adequate, uniform temperature. This can be done with an energy saving, reliable, small size heating device of the present invention, which uniformly heats a heating member while controlling its temperature.

As for the heat roller, the heating member must be provided with a cylindrical configuration. For this purpose, use may be made of any one of the devices shown in FIGS. 8, 14 and 15. By using a Litz wire as a winding, it is possible to reduce the loss of the winding and thereby to lower the temperature of the winding. This further enhances the energy saving effect.

In summary, it will be seen that the present invention provides an induction heating device including a switching power source and an image processing apparatus using the same having various unprecedented advantages, as enumerated blow.

(1) A controller assigned to one of a plurality of power source lines controls the power source line on the basis of a variable ON or OFF width. A controller assigned to the other power source line executes control with a control signal produced by thinning down a signal synchronous to the above one line. Therefore, pulse widths and periods are identical throughout the different power source lines. This obviates sound ascribable to noise interference and thereby enhances the reliability and miniaturization of the power source device.

(2) Only necessary one of the different power source lines can be activated in order to save energy.

(3) Conversion circuitry is implemented by resonance type converters and/or inverters. This reduces or fully obviates the switching loss of the power source device and further enhances the energy saving feature, reliability, and miniaturization.

(4) By implementing control circuitry as a digital operation circuit, it is possible to insure the stable operation of the energy saving, reliable and miniature power source device.

(5) By using an IC for the control circuitry, the energy saving, reliable power source device can be further miniaturized.

(6) The conversion circuitry is implemented by inverters while the control circuitry executes feedback control based on the output of the inverters. The power source device can therefore feed desired high-frequency power.

(7) The conversion circuitry is implemented by converters while the control circuitry executes feedback control based on the output of the converters. Therefore, switching ON widths and frequencies are identical throughout the different power source lines. This reduces the iron loss (hysteresis loss) of a transformer included in the individual power source line.

(8) The induction heating device includes a plurality of induction coils connected to a single high-frequency power source device in parallel, so that a high-frequency current is fed to the induction coils at the same time in the same phase. The current is controlled coil by coil. This obviates interference between high-frequency power sources and therefore irregular heating of a heating member. Also, a change in the dimension of a heating range or that of an object to be heated can be coped with. Further, power can be varied coil by coil. The device is therefore energy saving, reliable, and miniature.

(9) When the induction coils are connected to the high-frequency power source device in series, current to be fed to part of the induction coils is controlled. This is also successful to achieve the above advantage (8).

(10) Inverters are used to further enhance the control ability.

(11) The outputs of the inverters are controlled on the basis of the outputs of temperature sensing means responsive to the temperature of the heating member. This allows the temperature of the heating member to be controlled and further enhances the temperature control ability of the induction heating device.

(12) A voltage resonance circuit includes capacitors connected to the induction coils in parallel, so that the loss and cost of the induction heating device are further reduced.

(13) The induction coils each are made up of a plurality of remote portions, so that a temperature pattern, for example, can be readily provided with symmetry. It follows that the induction heating device achieves a temperature distribution extremely close to a target distribution.

(14) Each induction coil is implemented by a group of coils connected in parallel, so that a high-frequency current can be fed to the group at the same time in the same phase. The coils belonging to the same group can be turned with a point of connection thereof used as a reference. The energy saving, reliable and miniature heat induction device can therefore be constructed at low cost.

(15) When the heating member is implemented as a cylinder, it can be used as a roller. The induction heating device is therefore usable for various purposes.

(16) When the induction coils are implemented by Litz lines, the coils involve a minimum of loss and can therefore be lowered in temperature. This further reduces energy consumption and cost.

(17) When the above advantages (1) and (9) are realized with an electrophotographic image processing apparatus including fixing means, the performance of the image processing apparatus is enhanced.

Various modifications will become possible for those skilled in the art after receiving the teachings of the present disclosure without departing from the scope thereof.

What is claimed is:

1. An induction heating device comprising:

a power source device comprising:

a plurality of switching power source lines each including a conversion circuit, which selectively turns on or turns off an input by switching, and a controller for controlling a switching operation of said conversion circuit, wherein said plurality of switching power source lines operate as power sources for feeding currents to a plurality of induction coils, which heat a heating member by induction, while the controller executes feedback control in accordance with temperatures of different portions of said heating member corresponding in position to said plurality of induction coils, wherein the controller assigned to one of said plurality of switching power source lines variably controls an ON width or an OFF width while the controller assigned to the other switching power source line executes control with a signal produced by thinning down a signal synchronous to the one switching power source line.

2. An induction heating device as claimed in claim 1, wherein said plurality of induction coils each are made up of split portions.

3. An induction heating device comprising:

a power source device comprising:

a plurality of switching power source lines each including a conversion circuit, which selectively turns on or turns off an input by switching;

at least one thermosensitive device configured to sense a temperature at a heating member; and a controller for controlling a switching operation of said conversion circuit, wherein said plurality of switching power source lines operate as power sources for feeding currents to a plurality of induction coils, which heat a heating member by induction, while the controller executes feedback control in accordance with temperatures sensed by said at least one thermosensitive device of different portions of said heating member corresponding in position to said plurality of induction coils, wherein the controller assigned to one of said plurality of switching power source lines variably controls an ON width or an OFF width while the controller assigned to the other switching power source line executes control with a signal produced by thinning down a signal synchronous to the one switching power source line.

4. An induction heating device as claimed in claim 3, wherein said plurality of induction coils each are made up of split portions.

* * * * *

UNITED STATES PATENT AND TRADEMARK OFFICE

CERTIFICATE OF CORRECTION

PATENT NO. : 6,977,362 B2
APPLICATION NO. : 10/890242
DATED : December 20, 2005
INVENTOR(S) : Ohishi et al.

It is certified that error appears in the above-identified patent and that said Letters Patent is hereby corrected as shown below:

On the title page, Item (30), the Foreign Application Information is incorrect. Item (30) should read:

-- (30) Foreign Application Priority Data

Dec. 24, 1999 (JP) …….. 11-366429
May 9, 2000 (JP) …….. 2000-135464
Aug. 17, 2000 (JP) …….. 2000-247805 --

Signed and Sealed this

First Day of January, 2008

JON W. DUDAS
*Director of the United States Patent and Trademark Office*